United States Patent [19]

Nishijima et al.

[11] Patent Number: 4,684,603

[45] Date of Patent: Aug. 4, 1987

[54] LIGHT-SENSITIVE SILVER HALIDE COLOR PHOTOGRAPHIC MATERIAL

[75] Inventors: Toyoki Nishijima; Kaoru Onodera, both of Odawara, Japan

[73] Assignee: Konishiroku Photo Industry Co., Ltd., Tokyo, Japan

[21] Appl. No.: 805,120

[22] Filed: Dec. 4, 1985

[30] Foreign Application Priority Data

Dec. 12, 1984 [JP] Japan ..... 59-262339
Dec. 19, 1984 [JP] Japan ..... 59-269290

[51] Int. Cl.[4] ..... G03C 7/40; G03C 7/26

[52] U.S. Cl. ..... 430/372; 430/551; 430/558

[58] Field of Search ..... 430/551, 558, 554, 555, 430/372, 386

[56] References Cited

U.S. PATENT DOCUMENTS 4,500,630 2/1985 Sato et al. ..... 430/551
4,540,653 9/1985 Nishijima et al. ..... 430/558
4,581,326 4/1986 Katoh et al. ..... 430/558

*Primary Examiner*—John L. Goodrow
*Attorney, Agent, or Firm*—Frishauf, Holtz, Goodman & Woodward

[57] ABSTRACT

There is disclosed a light-sensitive silver halide photographic material which comprises containing at least one coupler represented by the formula (I) shown below and at least one of the compounds represented by the formulae (XI) and (XII) shown below:

(I)

wherein Z represents a group of non-metallic atoms necessary for forming a nitrogen-containing heterocyclic ring which may have a substituent; X represents a hydrogen atom or a substituent eliminatable through the reaction with the oxidized product of a color developing agent; and R represents a hydrogen atom or a substituent, (XI)

(XII)

wherein $X^1$, $X^2$ and $X^4$ each represents an oxygen atom, a sulfur atom or —$NR^{10}$—($R^{10}$ represents a hydrogen atom, an alkyl group, an aryl group or a hydroxyl group); $X^3$ represents a hydroxyl group or a mercapto group; Y represents an oxygen atom or a sulfur atom; $R^1$, $R^2$ and $R^3$ each represents a hydrogen atom, an alkyl group or an aryl group, provided that at least two of $R^1$, $R^2$ and $R^3$ represent alkyl groups or aryl groups; $R^4$, $R^5$, $R^6$, $R^7$, $R^8$ and $R^9$ each represents an alkyl group, an aryl group, an alkoxy group, an aryloxy group, an alkoxycarbonyl group, an aryloxycarbonyl group, and acyl group, an acylamino group, an arylamino group, an alkylamino group, a carbamoyl group, a sulfamoyl group, a sulfonamide group, a sulfonyl group or a cycloalkyl group, or they can be linked to each other to form a 5- or 6-membered ring; M represents a metal atom; a, b, c, d, e and f each represent an integer of 0 to 4.

19 Claims, No Drawings

LIGHT-SENSITIVE SILVER HALIDE COLOR PHOTOGRAPHIC MATERIAL

BACKGROUND OF THE INVENTION

This invention relates to a light-sensitive silver halide photographic material, particularly to a light-sensitive silver halide photographic material improved in color reproducibility.

As the method for forming a dye image by use of a light-sensitive color photographic material, there may be mentioned the method in which a dye is formed through the reaction between a coupler for photography and the oxidized product of a color developing agent. For the coupler for photography for effecting ordinary color reproduction, the respective couplers of magenta, yellow and cyan, while for the color developing agent, an aromatic primary amine type color developing agent, have been recommended to be used. Through the reaction of the respective couplers of magenta and yellow with the oxidized product of an aromatic primary amine type color developing agent, dyes such as azomethyne dye, etc. are formed, and through the reaction of a cyan coupler with the oxidized product of an aromatic primary amine type color developing agent, dyes such as indoaniline dye, etc. are formed.

Among them, for formation of a magenta color image, 5-pyrazolone, cyanoacetophenone, indazolone, pyrazolobenzimidazole, pyrazolotriazole type couplers, etc. may be used.

In the prior art, most of the magenta color image forming couplers conventionally used have been 5-pyrazolone type couplers. The color image formed from a 5-pyrazolone type coupler, although it is excellent in fastness to light and heat, is not satisfactory in the tone of the dye, with unnecessary absorption of light correspondent to the yellow component existing at around 430 nm and also the absorption spectrum of visible light at around 550 nm being broad, whereby color turbidity may be caused giving rise to a photographic image lacking in clearness.

As the coupler having no such unnecessary absorption, 1H-pyrazolo[3,2-c]-s-triazole type coupler, 1H-imidazo[1,2-b]-pyrazole type coupler, 1H-pyrazolo[1,5-b-]pyrazole type coupler or 1H-prazolo[1,5-d]tetrazole type coupler as disclosed in U.S. Pat. No. 3,725,067; Japanese Provisional Patent Publications No. 162548/1984 and No. 171956/1984 are particularly excellent.

However, the dye color images formed from these couplers are very low in fastness to light. When these couplers are used for light-sensitive materials, particularly those suitable for direct viewing, necessary conditions essentially required for photographic materials in recording and storage of images will be impaired.

Thus, they involve drawbacks in practical application. Accordingly, as the method improving light resistance, it has been proposed to use a phenol type or phenylether type antioxidant, as disclosed in Japanese Provisional Patent Publication No. 125732/1984.

However, no satisfactory effect of improving light resistance could be obtained. On the other hand, compounds represented by the formulae (XI) and (XII) (shown in the next page) have marked effect in improving light resistance, but they have the drawback of increased colored staining during prolonged storage (or heating) of the photographic image and were also not satisfactory in photographic performance (gradation).

Particularly, they had the drawback of soft tone at the low density portion (leg portion). Accordingly, it would be desirable to have a light-sensitive photographic material which is free from any of these drawbacks and capable of forming a magenta image having good light resistance.

SUMMARY OF THE INVENTION

An object of the present invention is to provide a light-sensitive silver halide photographic material which is good in color reproducibility of magenta image, light fastness of magenta image and also good in photographic performance (gradation) without increase of color staining by heat.

The above object of the present invention has been accomplished by a light-sensitive silver halide photographic material, which comprises at least one coupler represented by the formula (I) shown below and at least one of the compounds represented by the formulae (XI) and (XII) shown below:

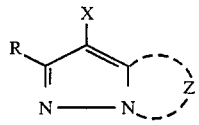

(I)

wherein Z represents a group of non-metallic atoms necessary for forming a nitrogen-containing heterocyclic ring which may have a substituent; X represents a hydrogen atom or a substituent eliminatable through the reaction with the oxidized product of a color developing agent; and R represents a hydrogen atom or a substituent,

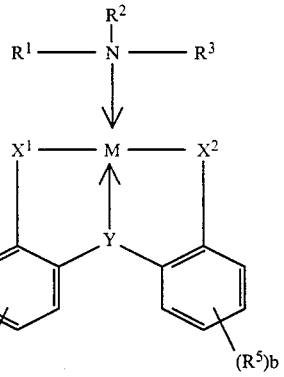

(XI)

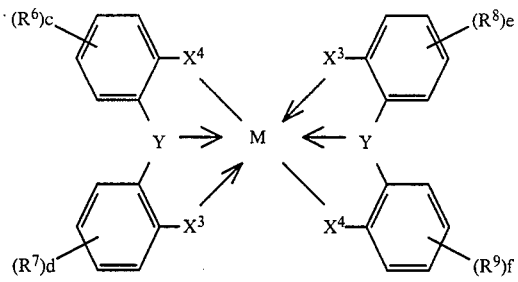

(XII)

wherein $X^1$, $X^2$ and $X^4$ each represent an oxygen atom, a sulfur atom or $NR^{10}$— ($R^{10}$ represents a hydrogen atom, an alkyl group, an aryl group or a hydroxyl group); $X^3$ represents a hydroxyl group or a mercapto group; Y represents an oxygen atom or a sulfur atom; $R^1$, $R^2$ and $R^3$ each represent a hydrogen atom, an alkyl group or an aryl group, provided that at least two of $R^1$, $R^2$ and $R^3$ represent alkyl groups or aryl groups; $R^4$, $R^5$, $R^6$, $R^7$, $R^8$ and $R^9$ each represent an alkyl group, an aryl group, an alkoxy group, an aryloxy group, alkoxycarbonyl group, an aryloxycarbonyl group, an acyl group, an acylamino group, an arylamino group, an alkylamino group, a carbamoyl group, a sulfamoyl group, a sulfonamide group, a sulfonyl group or a cycloalkyl group, or they can be linked to each other to form a 5- or 6-membered ring; M represents a metal atom; a, b, c, d, e and f each represent an integer of 0 to 4.

DESCRIPTION OF THE PREFERRED EMBODIMENTS

The present invention is to be described in detail below.

In the magenta coupler according to the present invention represented by formula (I):

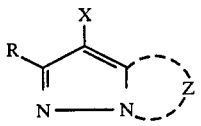

(I)

the substituent represented by the above R may include, for example, halogen atoms, an alkyl group, an alkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclicthio group; an alkyl group, a cycloalkyl group, an alkenyl group, a cycloalkenyl group, an alkynyl group, a heterocyclic group, a spiro compound residual group, a bridged hydrocarbon residual group, of which each root atom bonded directly to the ring is a carbon atom only one hydrogen atom bonded to said carbon atom.

As halogen atoms, for example, chlorine atom, or bromine atom may be used, particularly preferably chlorine atom.

The alkyl group represented by R may include preferably those having 1 to 32 carbon atoms, while the alkenyl group or the alkynyl group those having 2 to 32 carbon atoms. The alkyl group, alkenyl group or alkynyl group may be either straight or branched, and the cycloakyl group of cycloalkenyl group may preferably have 3 to 12, particularly 5 to 7 carbon atoms.

These alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; and those substituted through a carbonyl group such as an acyl group, a carboxy group, a carbamoyl group, an alkoxycarbonyl group; further those substituted through a hetero atom, specifically those substituted through an oxygen atom such as of a hydroxy group, an alkoxy group, an aryloxy group, etc.; those substituted through a nitrogen atom such as of a nitro group, an amino group (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.].

More specifically, there may be included, for example, a methyl group, an ethyl group, an isopropyl group, a t-butyl group, a sec-butyl group, a sec-amyl group, a 1-ethylpropyl group, a 1-ethylpentyl group, a 1-hexylnonyl group, a pentadecyl group, a heptadecyl group, a 1-heptyldecyl group, a 1-ethoxytridecyl group, a 1-methoxyisopropyl group, a 1-phenylisopropyl group, a 2-[4′-(4″-dodecyloxybenzenesulfonamido)phenyl]isopropyl group, a 1,1′-dipentylnonyl group, a 2-chloro-t-butyl group, a difluoromethyl group, a trifluoromethyl group, a 1-methoxyisopropyl group, a methanesulfonylethyl group, a 2,4-di-t-amylphenoxymethyl group, an anilino group, a 3-m-butanesulfoneaminophenoxypropyl group, a 3,4′-{α-[4″-(p-hydroxybenzenesulfonyl)phenoxy]dodecanoylamino}phenylpropyl group, a 3-{4′[α-(2″,4″-di-t-amylphenoxy)butaneamido]phenyl}propyl group, a 4-[α-(o-chlorophenoxy)tetradecaneamidophenoxy]propyl group, an allyl group, a cyclopropyl group, a cyclopentyl group, a cyclohexyl group and so on.

The aryl group represented by R may preferably be a phenyl group, which may also have a substituent (e.g. an alkyl group, an alkoxy group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4′-[α-(4″-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be employed.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphosphonyl group and the like; alkoxyphosphonyl groups such as an octyloxyphosphonyl group and the like; aryloxyphosphonyl groups such as a phenoxy-phosphonyl group and the like; arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may be substituted by an alkyl group, an aryl group (preferably a phenyl group), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The bridged hydrocarbon residual group represented by R may be, for example, bicyclo[2.2.1]heptan-1-yl, tricyclo[3.3.1.1$^{3,7}$]decan-1-yl, 7,7-dimethylbicyclo[2.2.1]heptan-1-yl and the like.

The alkoxy group represented by R may be substituted by those as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those groups as mentioned above as substituents or atoms for the aryl groups, including a phenoxy group, a p-t-butylphenoxy group, a m-pentadecylphenoxy group and the like.

The heterocyclicoxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, a m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably a phenylcarbonylamino group), etc., which may further have substituents, specifically an acetamide group, an α-ethylpropaneamide group, an N-phenylacetamide group, a dodecaneamide group, a 2,4-di-t-amylphenoxyacetamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-t-amylbenzenesulfonamide group and the like.

The imide group represented by R may be either open-chained or cyclic, which may also have substituents, as exemplified by a succinimide group, a 3-heptadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, a benzyloxycarbonyl group and the like.

The aryloxycarbonyl group represented by R may further have substituents, and may include a phenoxycarbonyl group, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phenethylthio group, a 3-phenoxypropylthio group and the like.

The arylthio group represented by R may preferably be a phenylthio group, which may further have substituents, and may include a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including a 2-pyridylthio group, a 2-benzothiazolylthio group, a 2,4-di-phenoxy-1,3,5-triazole-6-thio group and the like.

The spiro compound residue represented by R may be, for example, spiro[3.3]heptan-1-yl and the like.

The atom eliminatable through the reaction with the oxidized product of a color developing agent represented by X may include halogen atoms (e.g. a chlorine atom, a bromine atom, a fluorine atom, etc.).

Also, as the eliminatable group, there may be included groups substituted through a carbon atom, an oxygen atom, a sulfur atom or a nitrogen atom, and carboxyl groups.

The group substituted through a carbon atom may include the groups represented by the formula:

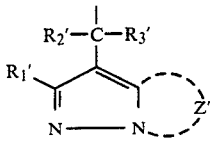

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy group.

Said alkoxy group may further have substituents, including an ethoxy group, a 2-phenoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heterocyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio group.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

The group substituted through a nitrogen atom may include, for example, those represented by the formula:

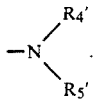

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms. Said alkyl group may be either straight or branched, having preferably 1 to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above for substituents on the alkyl group represented by $R_4'$ or $R_5'$ and alkyl groups.

Typical examples of said aryl group may be, for example, a phenyl group, a 1-naphthyl group, a 4-methylsulfonylphenyl group and the like.

The heterocyclic group represented by $R_4'$ or $R_5'$ may preferably be a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, an N,N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-carbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, a naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycarbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be either saturated or unsaturated, either has aromaticity or not, or may also be a fused ring.

Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, and alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring formed by Z and Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in the formula (I) and the formulae (II) to (VII) as hereinafter described has a moiety of the formula:

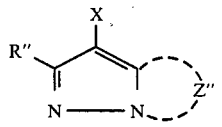

(wherein R'', X and Z'' have the same meanings as R, X and Z in the formula (I)), the so-called bis-form type coupler is formed, which is of course included in the present invention. The ring formed by Z, Z', Z'' and $Z_1$ as hereinafter described may also be fused with another ring (e.g. a 5- to 7-membered cycloalkene). For example, $R_5$ and $R_6$ in the formula (V), $R_7$ and $R_8$ in the formula (VI) may be bonded to each other to form a ring (e.g. a 5- to 7-membered ring).

The compounds represented by the formula (I) can be also represented specifically by the following formulae (II) through (VII).

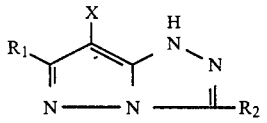

(II)

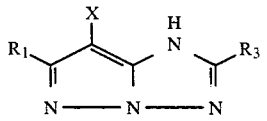

(III)

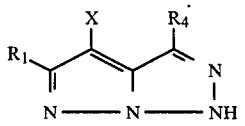

(IV)

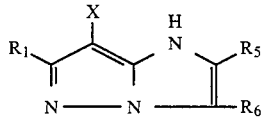

(V)

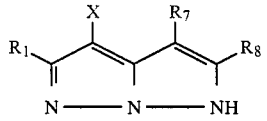

(VI)

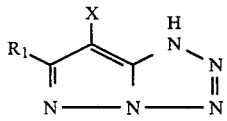

(VII)

In the above formulae (II) to (VII), $R_1$ to $R_8$ and X have the same meanings as the above R and X.

Of the compounds represented by the formula (I), those represented by the following formula (VIII) are preferred.

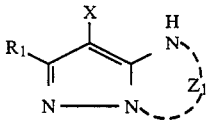

(VIII)

wherein $R_1$, X and $Z_1$ have the same meanings as R, X and Z in the formula (I).

Of the magenta couplers represented by the formulae (II) to (VII), the magenta coupler represented by the formula (II) is particularly preferred.

About the substituents in the formulae (II) to (VII), at least one of the substituents on the heterocyclic ring formed by Z and R in the formula (I), at least one of the substituents on the heterocyclic ring formed by $Z_1$ and $R_1$ in the formula (VIII), at least one of $R_1$ and $R_2$ in the formula (II), at least one of $R_1$ and $R_3$ in the formula (III), at least one of $R_1$ and $R_4$ in the formula (IV), at least one of $R_1$, $R_5$ and $R_6$ in the formula (V), at least one of $R_1$, $R_7$ and $R_8$ in the formula (VI), and $R_1$ in the formula (VII) should preferably be a tertiary alkyl group. More preferably, R in the formula (I), namely $R_1$ in the formulae (II) to (VII) should preferably be a tertiary alkyl group.

Here, the tertiary alkyl group represents an alkyl wherein no hydrogen is bonded to the root carbon at all.

Next, typical examples of the magenta couplers are shown, but they should not be construed as limitative of the present invention.

A-1

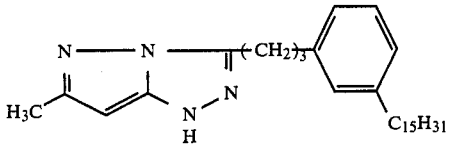

A-2

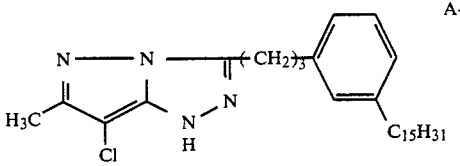

A-3

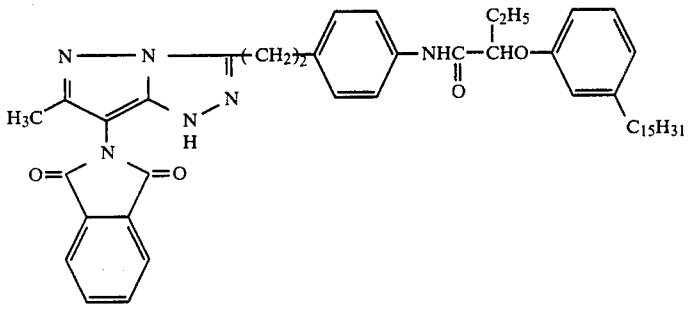

A-4

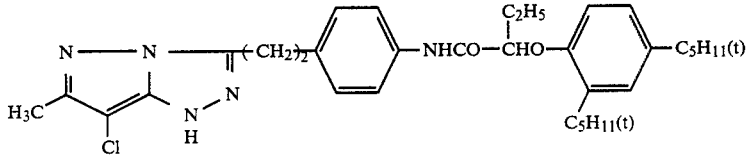

A-5

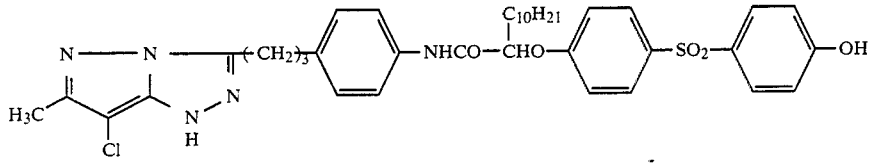

A-6

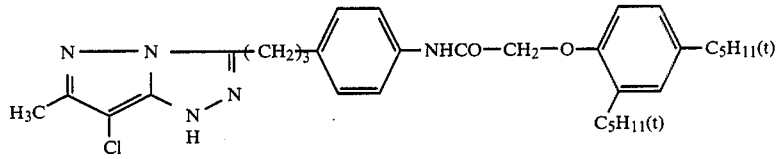

A-7

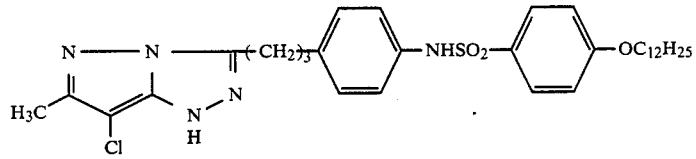

A-8

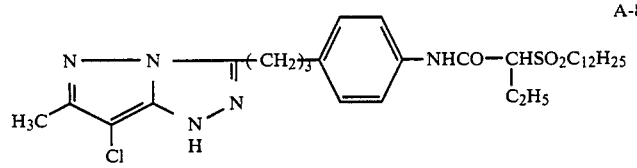

A-9

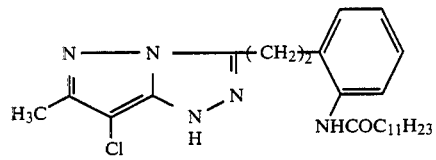

-continued
A-10
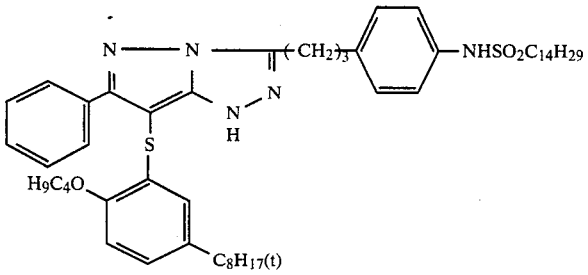
A-11
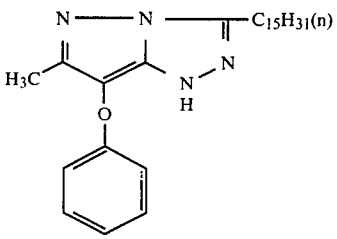
A-12
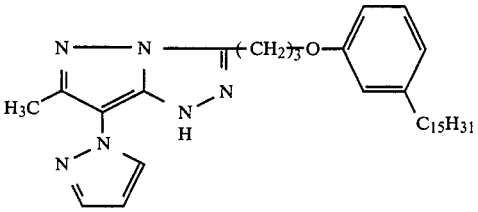
A-13
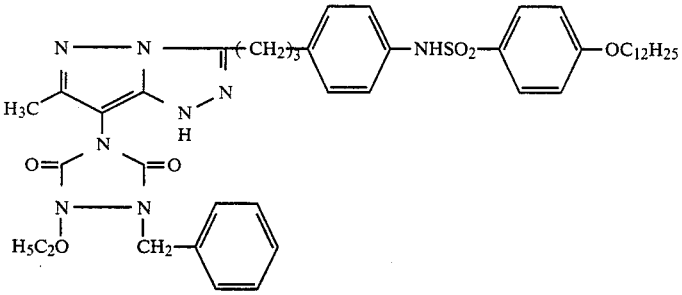
A-14
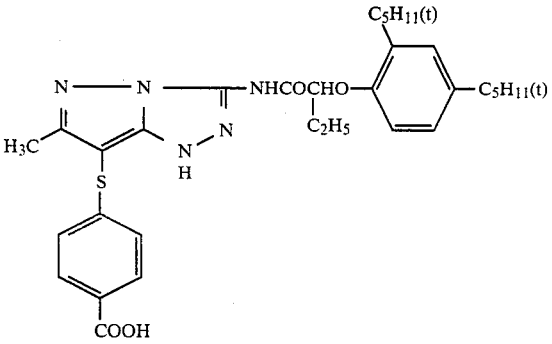
A-15
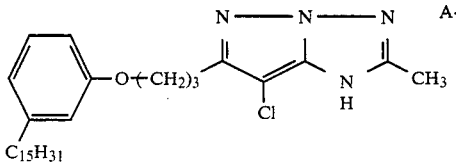
A-16
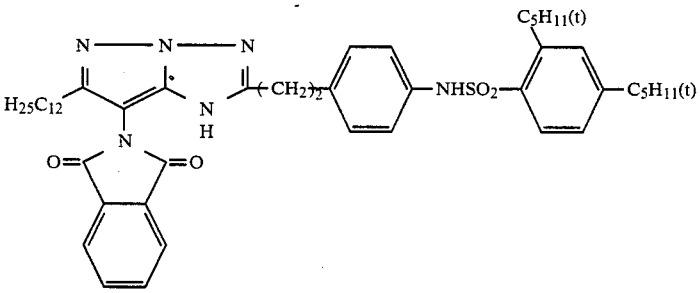
A-17
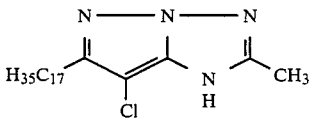
A-18
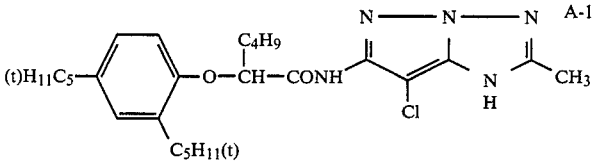
A-19
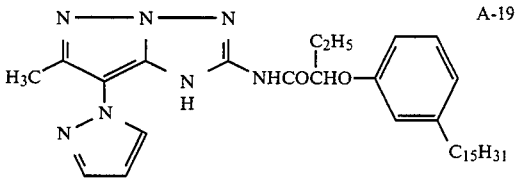

-continued
A-20
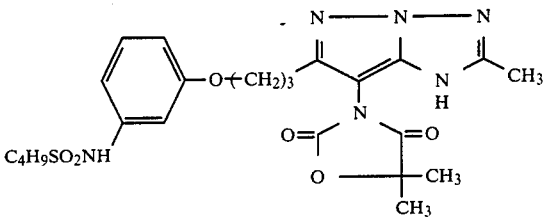
A-21
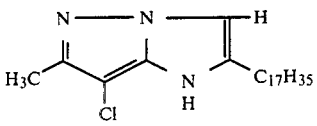
A-22
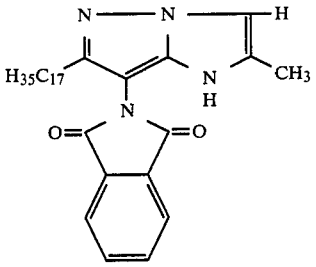
A-23
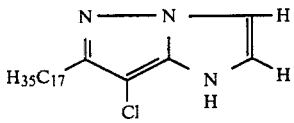
A-24
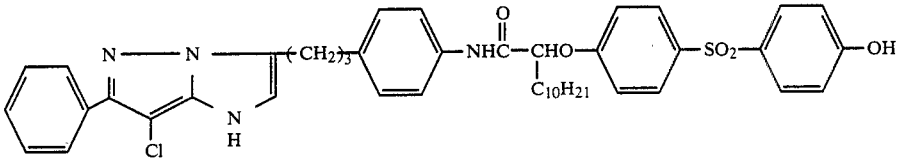
A-25
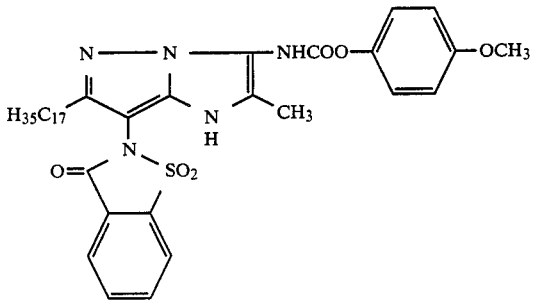
A-26
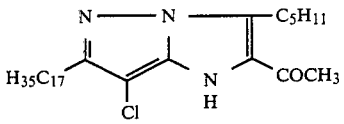
A-27
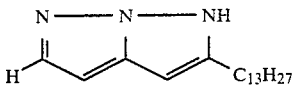
A-28
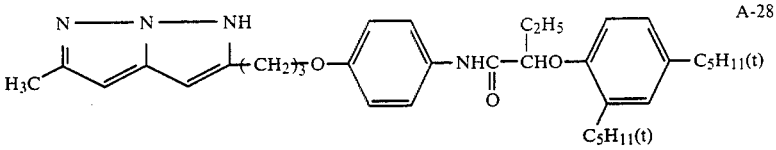
A-29
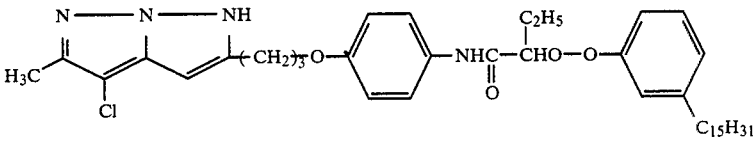
A-30
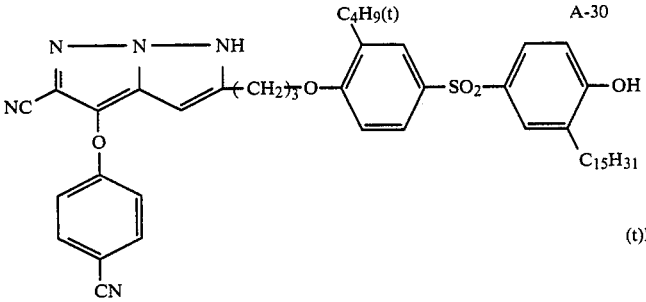
A-31
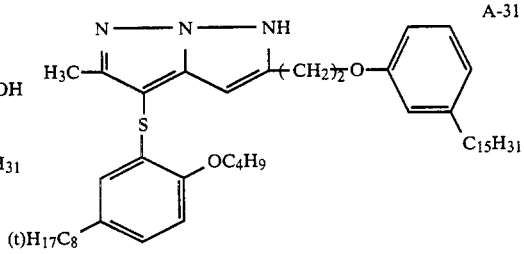

-continued
A-32
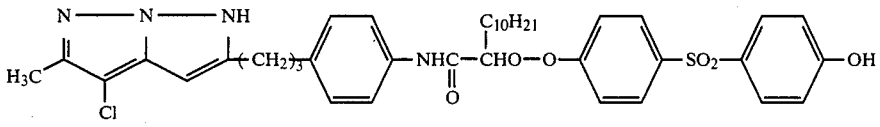
A-33
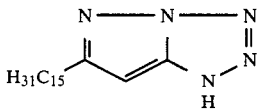
A-34
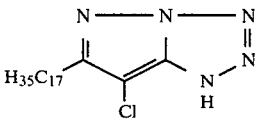
A-35
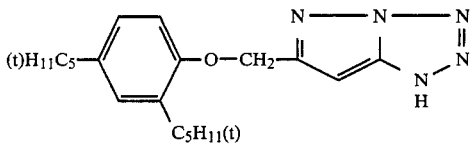
A-36
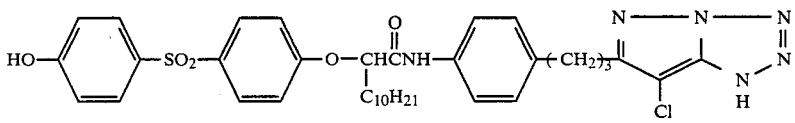
A-37
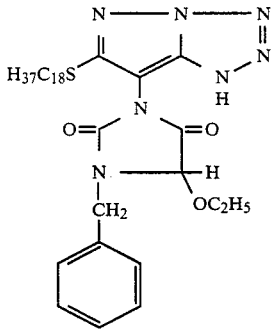
A-38
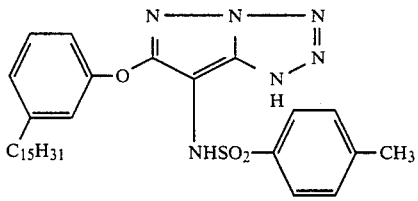
A-39
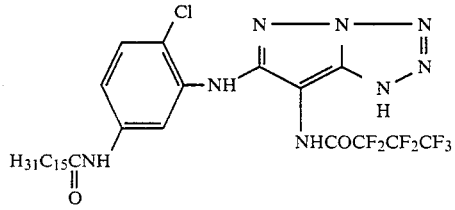
A-40
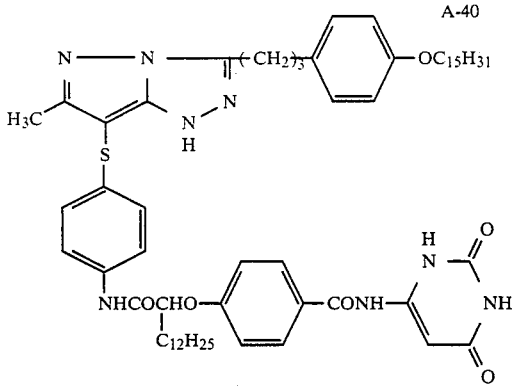
A-41
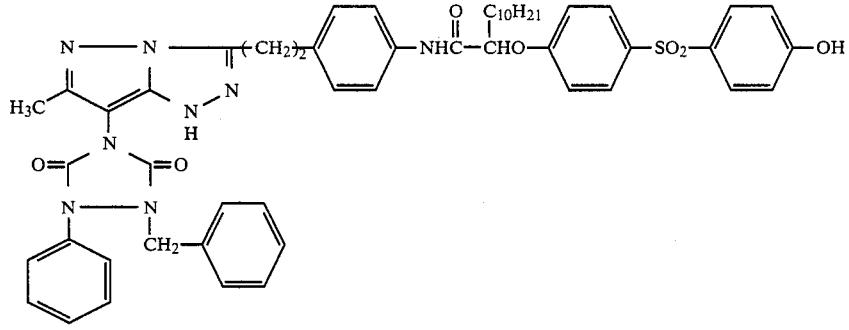

-continued

A-42

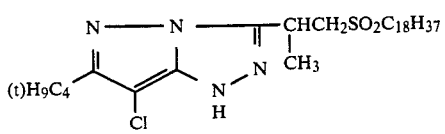

A-43

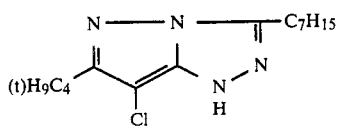

A-44

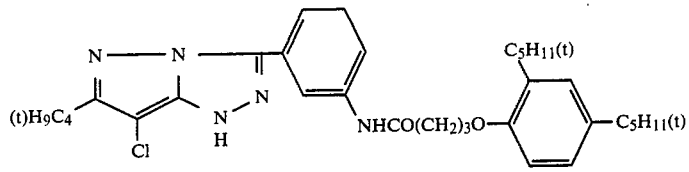

A-45

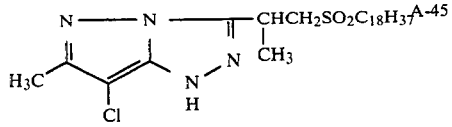

A-46

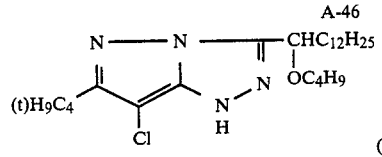

A-47

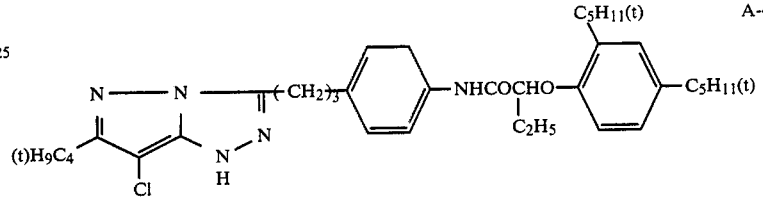

A-48

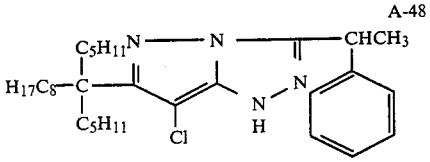

A-49

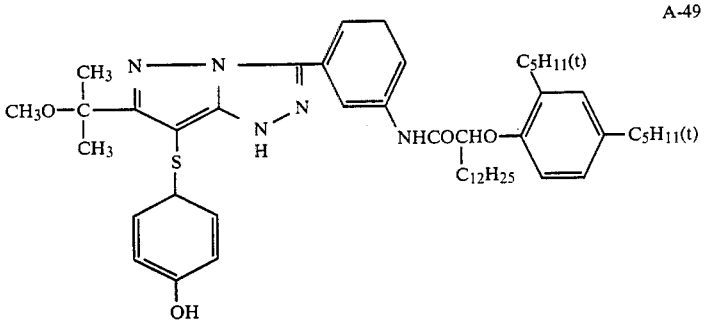

A-50

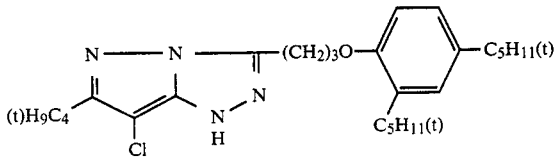

A-51

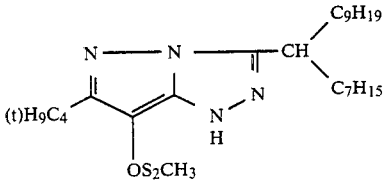

A-52

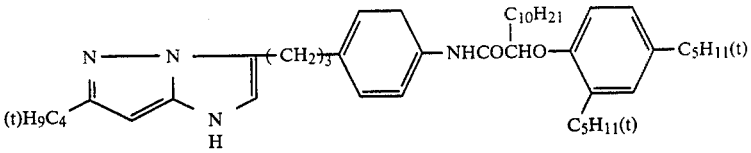

A-52'

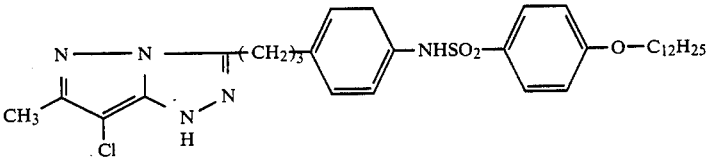

A-52''

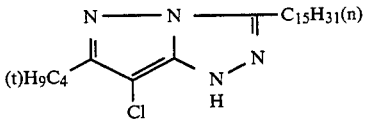

To describe about the substituents on the heterocyclic ring in the formulae (I) to (VIII), R in the formula (I) and $R_1$ in the formulae (II) to (VIII) should preferably satisfy the following condition:

Condition: the bondings between the root atom and adjacent atoms are all single bonds.

Of the substituents R and $R_1$ on the above heterocyclic ring, most preferred are those represented by the formula (IX) shown below:

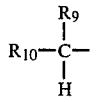

(IX)

In the above formula, each of $R_9$ and $R_{10}$ represents a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, $R_9$ and $R_{10}$ may be bonded together to form a saturated or unsaturated ring (e.g. cycloalkane ring, cycloalkene ring or heterocyclic ring).

The groups represented by $R_9$ or $R_{10}$ may have substituents, and examples of the groups represented by $R_9$ or $R_{10}$ and the substituents which may be possessed by said groups may include examples of the substituents which may be possessed by the nitrogen-containing heterocyclic ring formed by Z and Z' as described above, and substituents which may be possessed by said substituents.

Also, examples of the ring formed by bonding between $R_9$ and $R_{10}$ and the substituents which may be possessed by said ring may include examples of cycloalkyl, cycloalkenyl and heterocyclic groups as mentioned for substituents on the nitrogen-containing heterocyclic ring formed by Z or Z' as described and substituents thereof.

Of the compounds of the formula (IX), particularly preferred are:

(i) the case when both $R_9$ and $R_{10}$ are alkyl groups; and (ii) the case when $R_9$ and $R_{10}$ are bonded together with the root carbon atom to form a cycloalkyl group.

Here, said alkyl, said cycloalkyl may further have substituents, and examples of said alkyl, said cycloalkyl and substituents thereof may include those alkyl cycloalkyl and substituents thereof as mentioned for the substituents on the nitrogen-containing heterocyclic ring formed by the above Z or Z'.

In the following, examples of the magenta coupler of the present invention are enumerated, which are not limitative of the present invention.

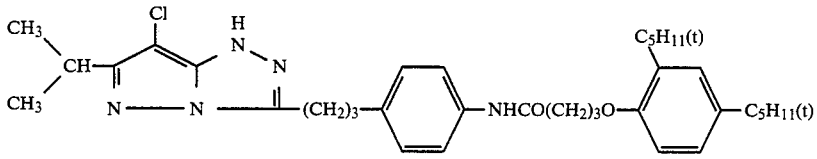

A-53

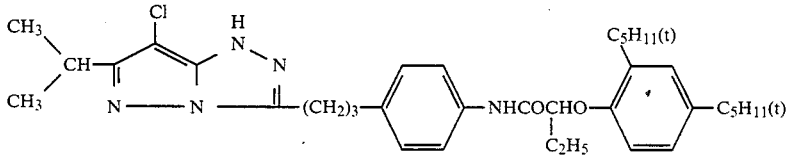

A-54

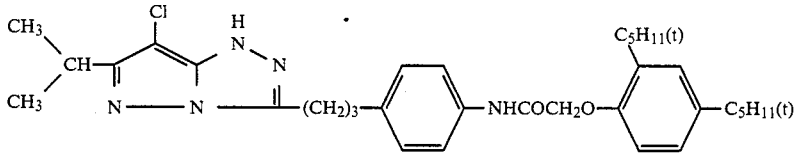

A-55

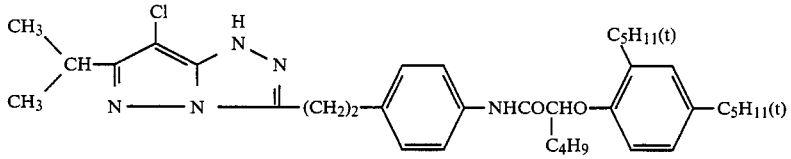

A-56

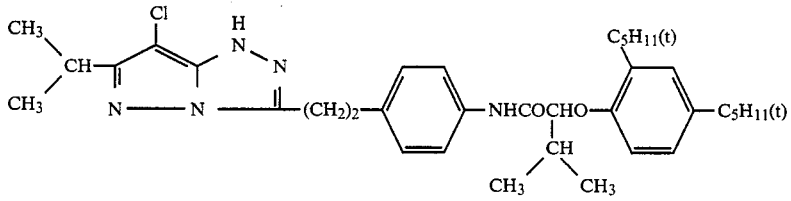

A-57

-continued
A-58
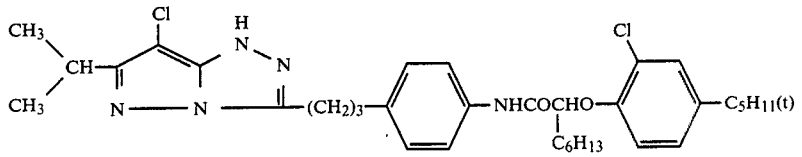
A-59
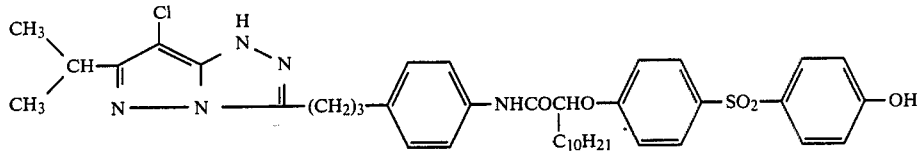
A-60
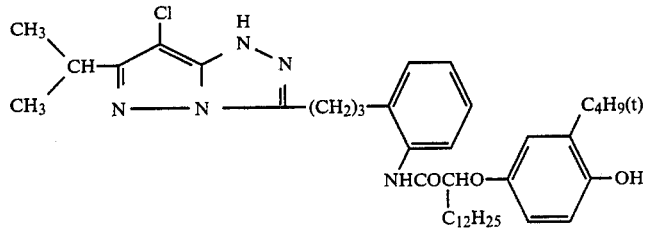
A-61
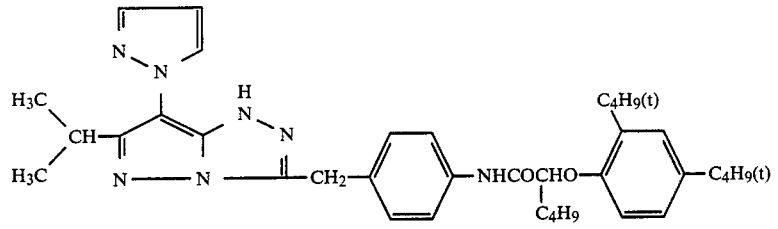
A-62
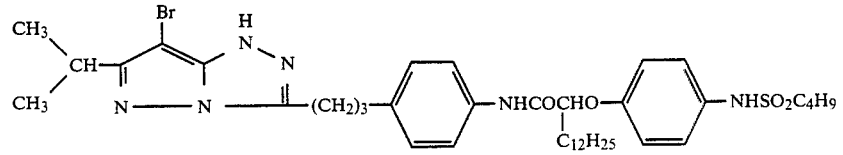
A-63
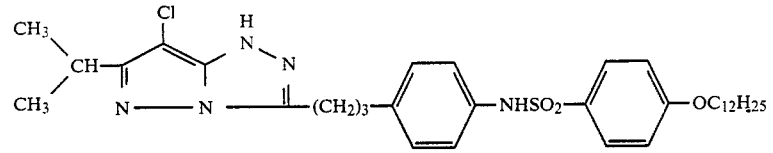
A-64
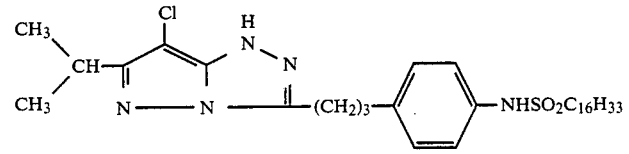
A-65
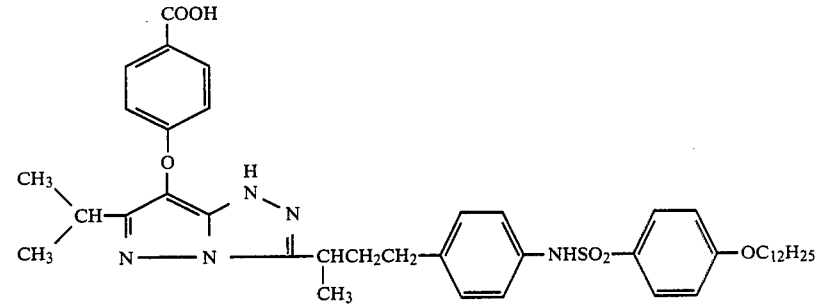

-continued
A-66
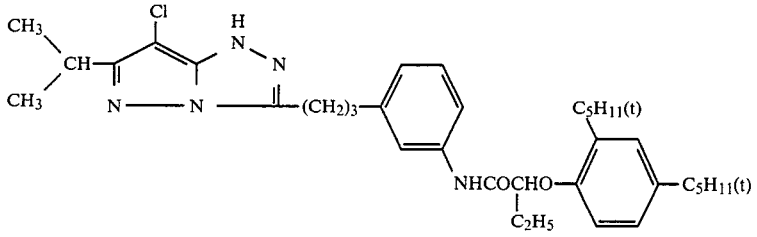
A-67
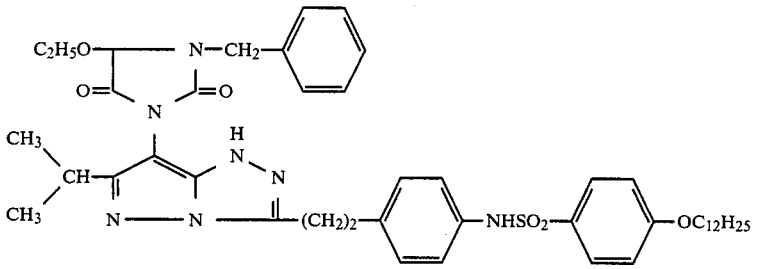
A-68
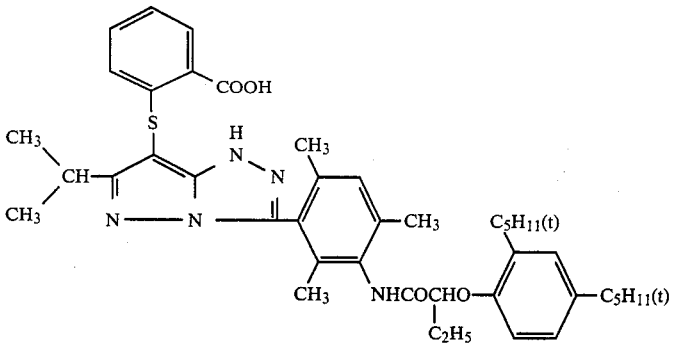
A-69
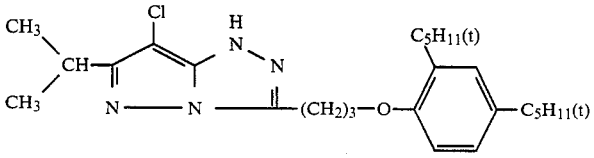
A-70
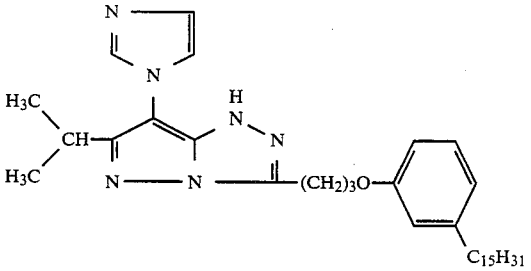
A-71
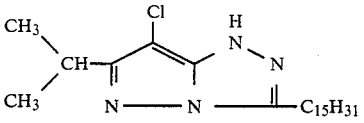
A-72
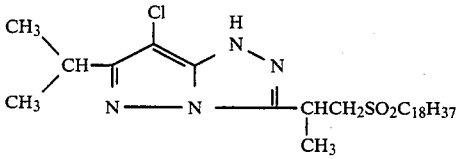
A-73
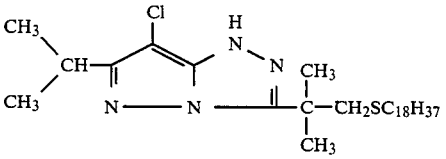
A-74
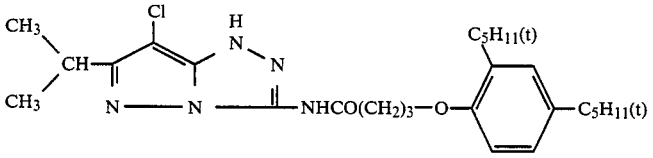

-continued
A-75
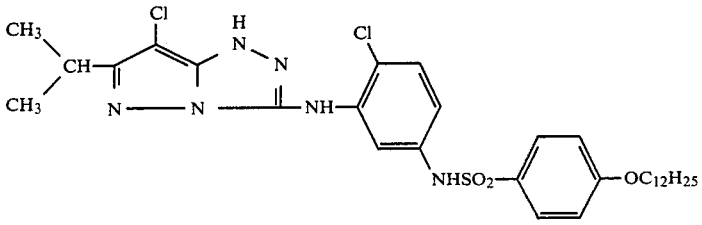
A-76
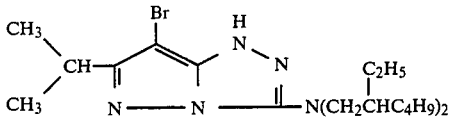
A-77
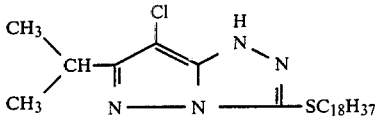
A-78
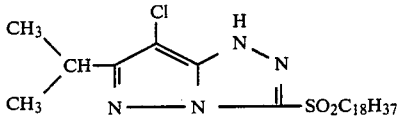
A-79
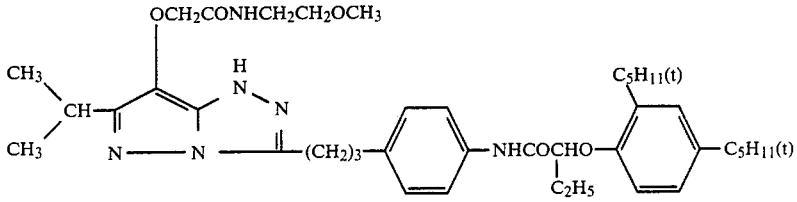
A-80
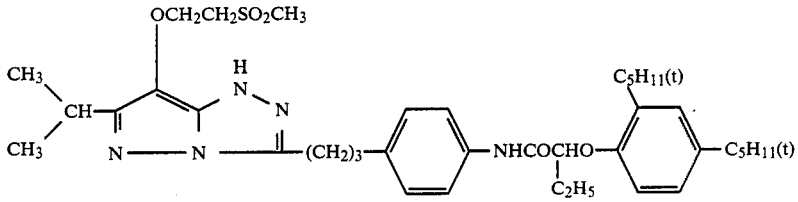
A-81
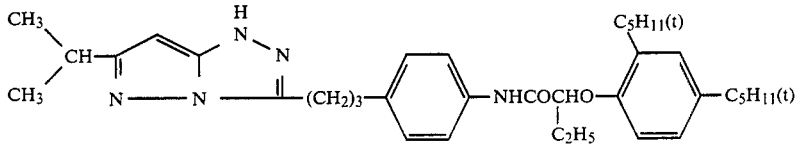
A-82
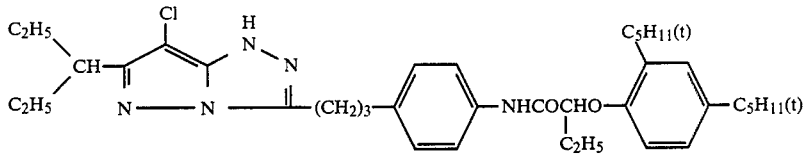
A-83
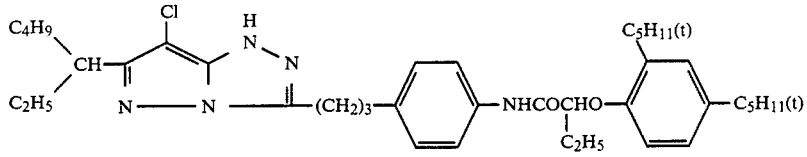
A-84
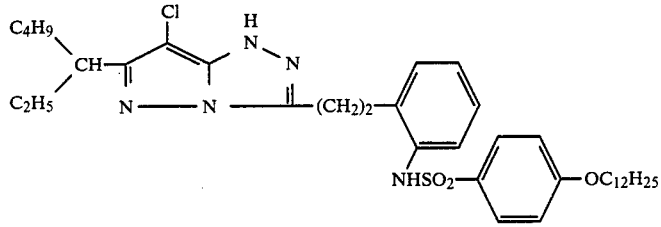

-continued
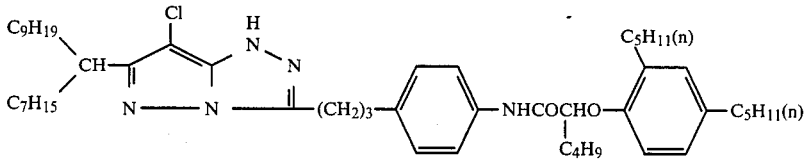
A-85
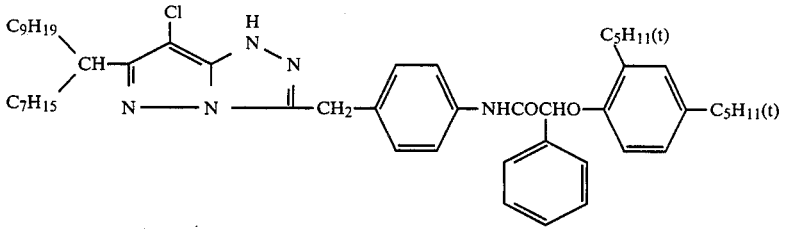
A-86
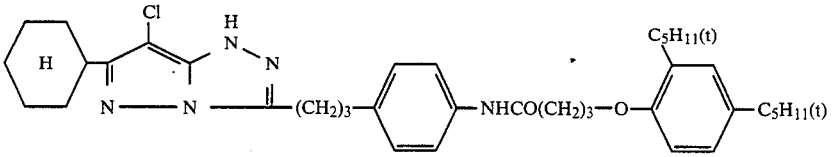
A-87
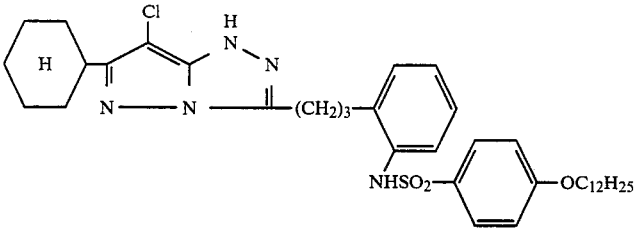
A-88
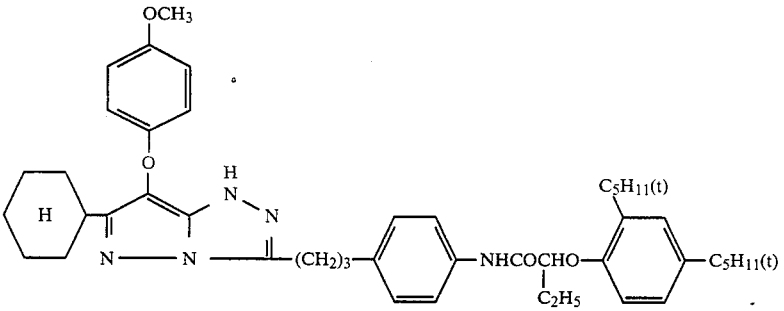
A-89
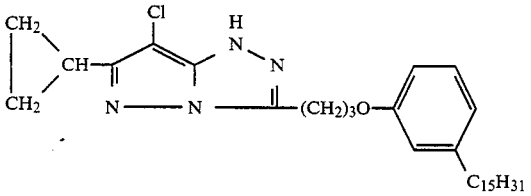
A-90
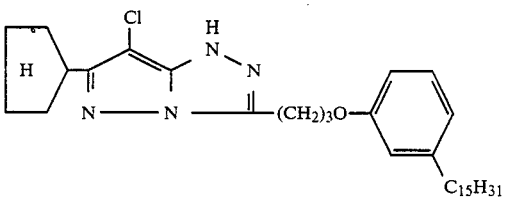
A-91
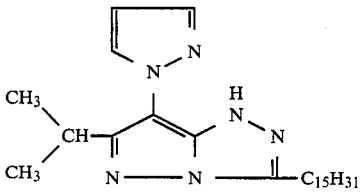
A-92

-continued
A-93
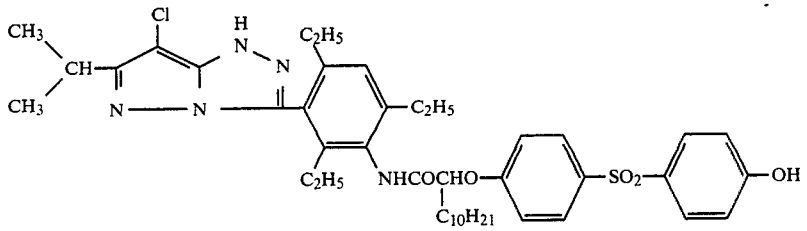
A-94
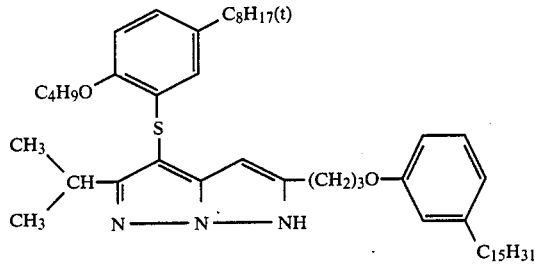
A-95
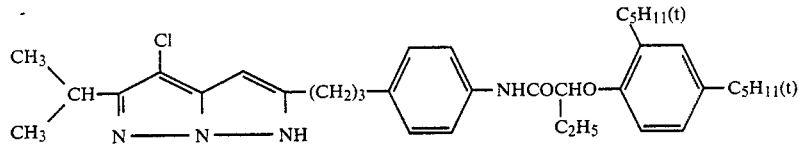
A-96
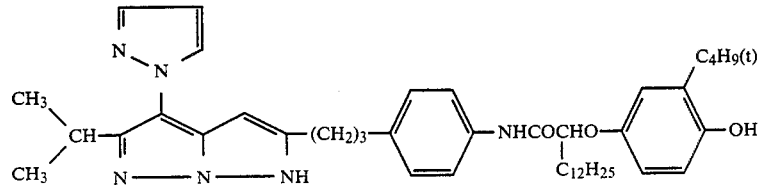
A-97
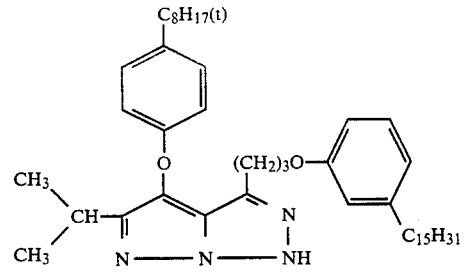
A-98
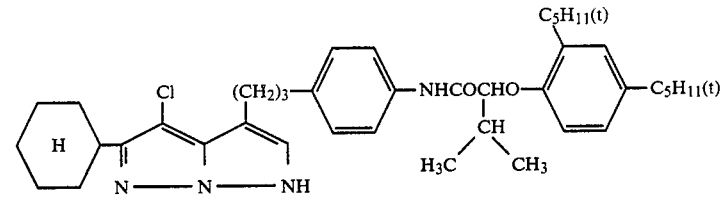
A-99
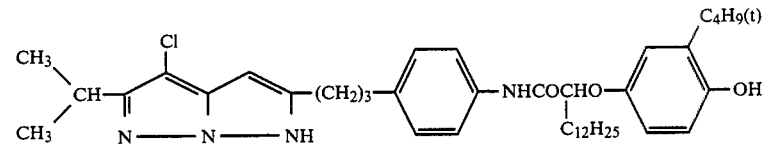

-continued

A-100

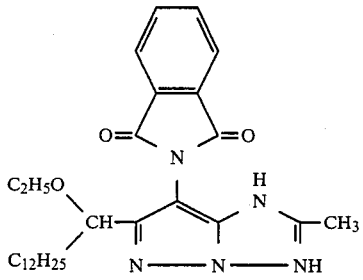

A-101

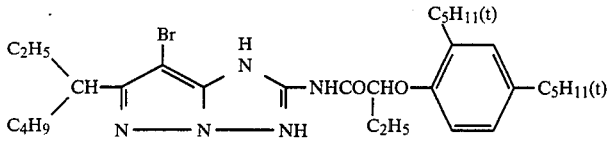

A-102

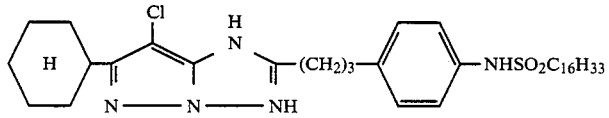

A-103

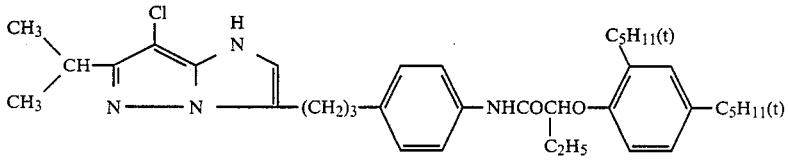

A-104

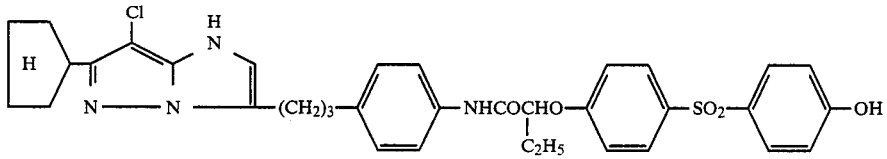

A-105

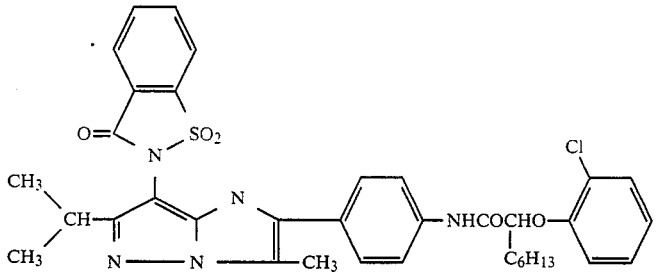

A-106

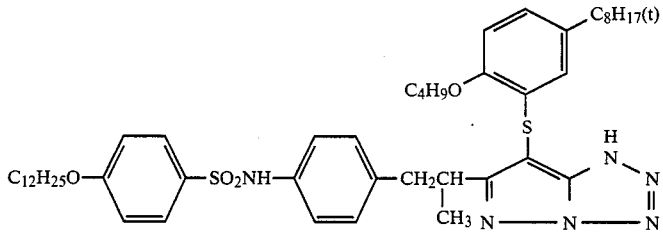

The above couplers were synthesized by referring to Journal of the Chemical Society, Perkin I (1977), pp. 2047-2052, U.S. Pat. No. 3,725,067, Japanese Provisional Patent Publications No. 99437/1984 and No. 42045/1984.

The coupler of the present invention can be used in an amount generally within the range of from $1\times10^{-3}$ mole to $5\times10^{-1}$ mole, preferably from $1\times10^{-2}$ to $5\times10^{-1}$ mole, per mole of the silver halide.

The coupler of the present invention can be used in combination with other kinds of magneta couplers.

When the light-sensitive silver halide photographic material is used as a multi-color light-sensitive photographic material, a yellow coupler and a cyan coupler conventionally used in this field of the art can be used in a conventional manner. Also, a colored coupler having the effect of color correction or a coupler which releases a developing inhibitor with development (DIR coupler) may be used, if necessary. The above coupler can be used as a combination of two or more kinds in the same layer or the same coupler may be added into the two or more layers, in order to satisfy the characteristics demanded for the light-sensitive material.

As the cyan coupler and the yellow coupler to be used in the present invention, there may be employed phenol type or naphthol type cyan couplers and acylacetamide type or benzoylmethane type yellow couplers, respectively.

These yellow couplers are described in, for example, U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, 3,894,875; West German Offenlegunsschrift No. 15 47 868, No. 20 57 941, No. 21 62 899, No. 21 63 812, No. 22 18 461, No. 22 19 917, No. 22 61 361 and No. 22 63 875; Japanese Patent Publication No. 13576/1974; Japanese Provisional Patent Publications No. 29432/1973, No. 66834/1973, No. 10736/1974, No. 122335/1974, No. 28834/1975 and No. 132926/1975.

The cyan couplers are described in, for example, U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763, 3,839,044 and 3,880,661; West German Offenlegunsschrift No. 21 63 811 and No. 22 07 468; Japanese Patent Publications No. 27563/1964 and No. 28836/1970; Japanese Provisional Patent Publications No. 37425/1972, No. 10135/1975, No. 25228/1975, No. 112038/1975, No. 117422/1975, No. 130441/1975, No. 109630/1978, No. 65134/1981 and No. 99341/1981; and Research Disclosure No. 14,853 (1976), etc.

In the present invention, the metal complex represented by the above formulae (XI) and (XII) (hereinafter called comprehensively as the metal complex according to the present invention) may be used either singly, as a combination of two or more compounds represented by each formula or as a combination of one or more compounds represented by the respective formulae. In any case, the object of the present invention can be fully accomplished.

$X^1$, $X^2$ and $X^4$ in the formulae (XI) and (XII) may be either identical or different from each other, each representing an oxygen atom, a sulfur atom or —$NR^{10}$— {$R^{10}$ is a hydrogen atom, an alkyl group (e.g. a methyl group an ethyl group, an n-propyl group, an i-propyl group, an n-butyl group, a t-butyl group, an i-butyl group, a benzyl group, etc.), an aryl group (e.g. a phenyl group, a tolyl group, a naphthyl group, etc.) or a hydroxyl group}, preferably an oxygen atom or a sulfur atom, most preferably an oxygen atom.

$X^3$ in the formula (XII) represents a hydroxyl group or a mercapto group, preferably a hydroxyl group.

Y in the formulae (XI) and (XII) represents (there are two Y's in the formula (XII), and they may be either the same or different from each other) an oxygen atom or a sulfur atom, preferably a sulfur atom.

In the formulae (XI) and (XII), $R^4$, $R^5$, $R^6$, $R^7$, $R^8$ and $R^9$ each represent an alkyl group (e.g. a straight or branched alkyl group having 1 to 20 carbon atoms such as a methyl group, an ethyl group, an n-propyl group, an n-butyl group, an n-octyl group, a t-octyl group, an n-hexadecyl group and the like), an aryl group (e.g. a phenyl group, a naphthyl group, etc.), an alkoxy group (e.g. a straight or branched alkyloxy group such as a methoxy group, a n-butoxy group, an t-butoxy group, etc.), an aryloxy group (e.g. a phenoxy group, etc.), an alkoxycarbonyl group (e.g. a straight or branched alkyloxycarbonyl group such as an n-pentyloxycarbonyl group, a t-pentyloxycarbonyl group, an n-octyloxycarbonyl group, a t-octyloxycarbonyl group, etc.), an aryloxycarbonyl group (e.g. a phenoxycarbonyl group, etc.), an acyl group (e.g. a straight or branched alkylcarbonyl group such as an acetyl group, a stearoyl group, etc.) an acylamino group (e.g. a straight or branched alkylcarbonylamino group such as an acetamide group, etc., an arylcarbonylamino group such as a benzoylamino group, tc.), an arylamino group (e.g. an N-phenylamino group, etc.), an alkylamino group (e.g. a straight or branched alkylamino group such as an N-n-butylamino group, an N,N-diethylamino group, etc.), a carbamoyl group (e.g. a straight or branched alkylcarbamoyl group such as an n-butylcarbamoyl group, etc.), a sulfamoyl group (e.g. a straight or branched alkylsulfamoyl group such as an N,N-di-n-butylsulfamoyl group, an N-n-dodecylsulfamoyl group, etc.), a sulfonamide group (e.g. a straight or branched alkylsulfonylamino group such as a methylsulfonylamino group, etc., an arylsulfonylamino group such as a phenylsulfonylamino group, etc.), a sulfonyl group (e.g. a straight or branched alkylsulfonyl group such as a mesyl group, etc., an arylsulfonyl group such as a tosyl group, etc.) or a cycloalkyl group (e.g. a cyclohexyl group, etc.). Also the two substituents may form a 5- or 6-membered ring (e.g. benzene ring) by ring closure.

M in the formulae (XI) and (XII) represents a metal atom, preferably a transition metal such as a nickel atom, a copper atom, a cobalt atom, a palladium atom, an iron atom or a platinum atom, particularly preferably a nickel atom.

The alkyl group represented by $R^1$, $R^2$ and $R^3$ in the formula (XI) may be either straight or branched (e.g. a methyl group, an ethyl group, an n-propyl group, an n-butyl group, an n-octyl group, an n-hexadecyl group and the like), and the aryl group represented by $R^1$, $R^2$ and $R^3$ may include phenyl, naphthyl, etc.

These alkyl and aryl groups may also have substituents (e.g. an alkoxy group, an aryloxy group, an alkoxycarbonyl group, an aryloxycarbonyl group, an acyl group, an acylamino group, an arylamino group, an alkylamino group, a carbamoyl group, a sulfamoyl group, a sulfonamide group, a sulfonyl group, a cycloalkyl group, etc.).

These compounds may be of the bis-type structure like the exemplary compound B-13 described below.

Typical examples of the metal complexes according to the present invention are shown below, but the present invention is not limited thereto.

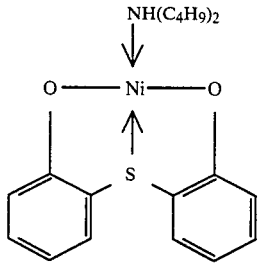
B-1
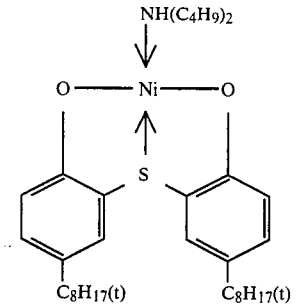
B-2
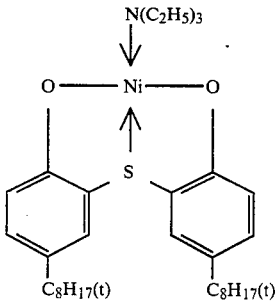
B-3
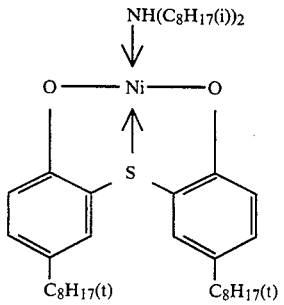
B-4
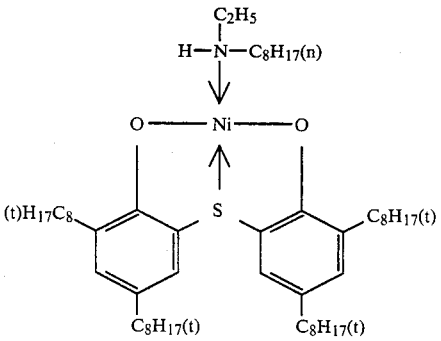
B-5
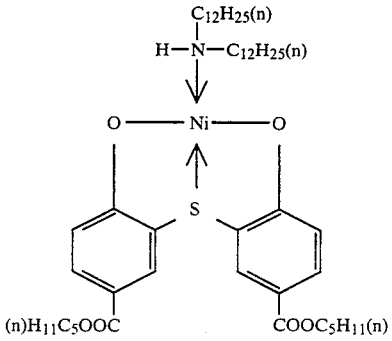
B-6
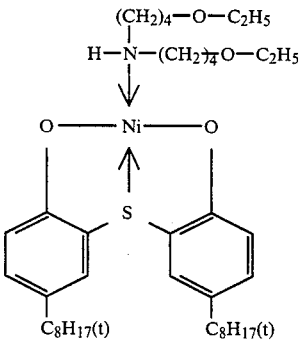
B-7
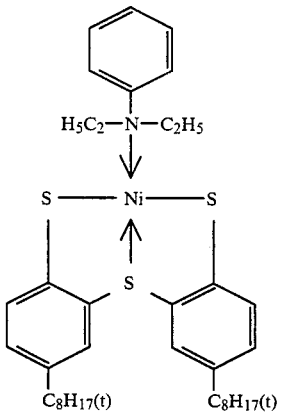
B-8

-continued
B-9
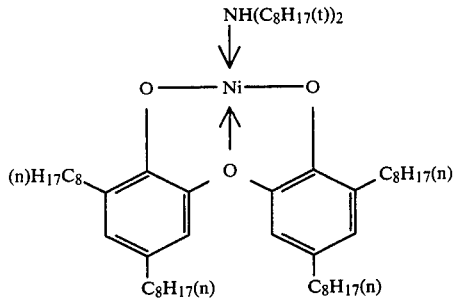
B-10
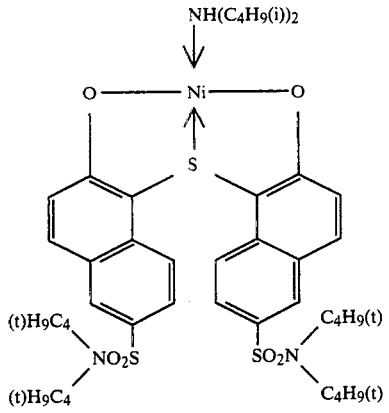
B-11
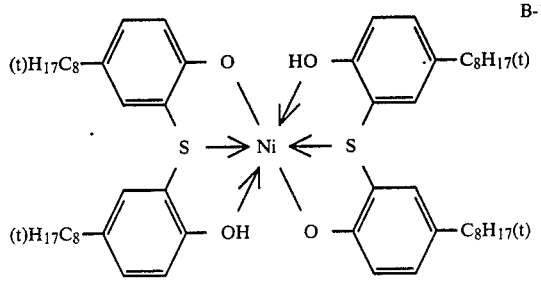
B-12
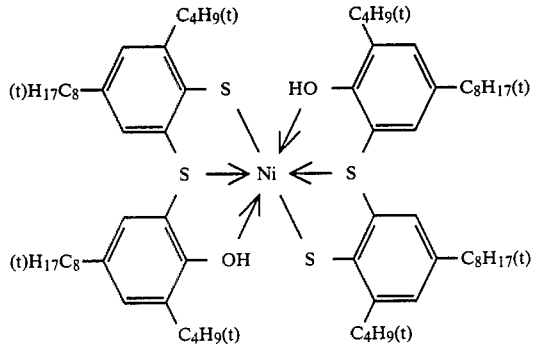
B-13
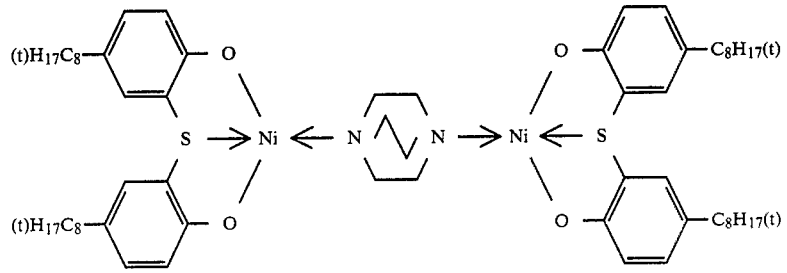
B-14
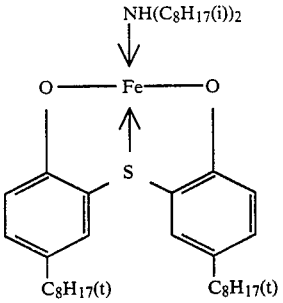
B-15
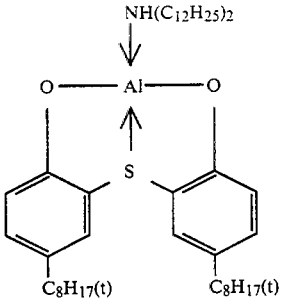
B-16
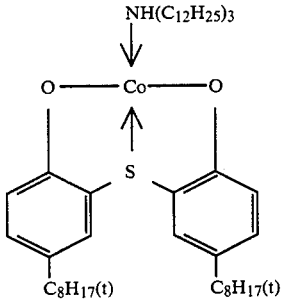
B-17
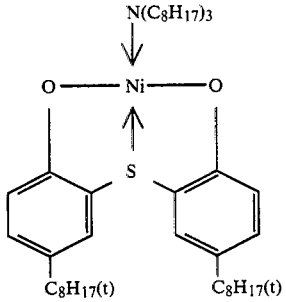

-continued

B-18

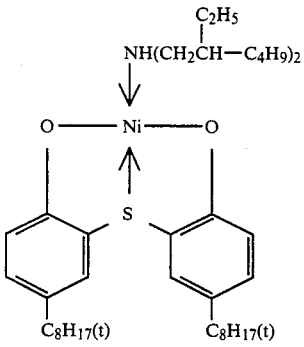

These complexes can be synthesized according to the methods disclosed in U.K. Pat. No. 858,890, West German Offenlegunsschrift 2,042,652, etc.

The complex according to the present invention may be used preferably at a proportion generally of 5 to 100% by weight based on the coupler according to the present invention, more preferably at a proportion of 10 to 50% by weight. Also, it is preferable to use the complex according to the present invention and the coupler according to the present invention in the same layer, more preferably, to permit them to exist in the same oil droplet.

As the method for dispersing the metal complex and the coupler as the above, there may be employed various methods such as the so-called alkali aqueous solution dispersing method, solid dispersing method, latex dispersing method, oil droplet-in-water type emulsifying method, etc., which methods can suitably be selected depending on the chemical structures of the coupler and the metal complex.

In the present invention, the latex dispersing method and the oil droplet-in-water type emulsifying method are particularly effective. These dispersing methods are well known in the art, and the latex dispersing method and its effects are described in Japanese Provisional Patent Publications No. 74538/1974, No. 59943/1976 and No. 32552/1979; Research Disclosure, August, 1976, No. 14,850, pp. 77–79.

Suitable latices comprise homopolymers, copolymers and terpolymers of monomers, including, for example, styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxypentyl)]acrylamide, 2-acrylamido-2-methylpropanesulfonic acid, etc. As the oil droplet-in-water emulsifying method, it is possible to apply the method known in the art in which a hydrophobic additive such as the coupler is dispersed. For example, there is the method in which the above diffusion resistant coupler is dissolved in a high boiling point solvent and finely dispersed in a hydrophilic colloid such as gelatin.

The above high boiling organic solvent may include esters such as phthalate, phosphate, etc., organic acid amides, ketone, hydrocarbon compounds, etc., but preferably high boiling organic solvents with a dielectric constant of 7.5 or less and 1.9 or more, having a vapor pressure of 0.5 mm Hg or lower at 100° C. useful high boiling point organic solvents may be exemplified by dibutyl phthalate, dioctyl phthalate, dinonyl phthalate, trioctyl phosphate, trinonyl phoshate, tricresyl phosphate, triphenyl phosphate, etc.

The light-sensitive silver halide photographic material of the present invention can be, for example, a negative or positive film for color as well as a color printing paper, and the effect of the present invention can be effectively exhibited when a color printing paper to be provided directly for viewing is employed.

The light-sensitive silver halide photographic material, typically the color printing paper, of the present invention may be either for single color or multi-color. In the case of a light-sensitive silver halide photographic material for multi-color, since subtractive color reproduction is effected, it has generally a structure having silver halide emulsion layers containing respective couplers of magenta, yellow and cyan as the colors for photography and non-light-sensitive layers laminated in an appropriate layer number and layer order on a support, and said layer number and layer order may appropriately be changed depending on the critical performance, purpose of use, etc.

The metal complex according to the present invention, when employed in combination with the magenta coupler according to the present invention, can give the effect of good light fastness as a result of a specific reaction. Accordingly, it is preferable to permit the metal complex according to the present invention to be contained in a silver halide emulsion layer containing the magenta coupler according to the present invention, ordinarily in a green-sensitive silver halide emulsion layer, in the light-sensitive silver halide photographic material, thus permitting it to exist in the layer in which a dye, obtained by exposing the light-sensitive silver halide photographic material to light and developing the exposed material in the presence of a color developing agent and formed through the reaction between the magenta coupler and the oxidized product of said color developing agent, is retained.

The silver halide to be used in the respective silver halide emulsion layers constituting the light-sensitive silver halide photographic material used for the present invention may include any of those conventionally used for silver halide emulsions such as silver chloride, silver bromide, silver iodide, silver chlorobromide, silver iodobromide, silver chloroiodobromide, etc. These silver halide grains may be either coarse or fine, and the distribution of grain sizes may be either narrow or broad.

Also, the crystals of these silver halide grains may be either normal crystals or twin crystals, with the ratio of (100) plane and (111) plane being any desired value. Further, the crystal structure of these silver halide grains may be either homogeneous from inner portions to outer portions or alternatively a layered structure with different inner and outer portions.

The silver halides may be either of the type in which latent image is formed primarily on their surfaces or of the type in which it is formed in inner portions thereof.

The silver halide grains can be prepared according to a known method conventionally used in this field of art. Said grains may also be doped with iridium, rhodium, etc.

Further, the photographic emulsion containing the above silver halide grains may also be applied with sulfur sensitization or selenium, reducing or noble metal sensitization. It is also possible to effect optical sensitization with various sensitizing dyes spectroscopically.

In the light-sensitive silver halide photographic material according to the present invention, in addition to various additives as mentioned above, there may also be added various additives such as development accelerators, film hardeners, surfactants, anti-staining agents, lubricants and other useful additives.

The support to be used for the light-sensitive silver halide photographic material used in the present invention may be any support known in the art such as a plastic laminate, baryta paper, synthetic paper, polyethyleneterephthalate film and triacetate cellulose film, and various workings may usually be applied to these supports for reinforcing adhesion with the silver halide emulsion layer.

The silver halide emulsion layers and non-light-sensitive layers to be used in the present invention may be provided by coating according to various methods, such as dip coating, air doctor coating, curtain coating, hopper coating, etc.

The aromatic primary amine color developing agent to be used in the color developing solution in the present invention may include known ones used widely in various color photographic processes. These developing agents include aminophenol type and p-phenylenediamine type derivatives. These compounds are used generally in the form of salts, for example, hydrochlorides or sulfates, for the sake of stability, rather than in the free state. Also, these compounds may be used at concentrations generally of about 0.1 g to about 30 g, per liter of the color developing solution, preferably of about 1 g to about 1.5 g per liter of the color developing solution.

The aminophenol type developing solution may contain, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino type color developing agents are N,N'-dialkyl-p-phenylenediamine type compounds, of which the alkyl group and phenyl group may be substituted by any desired substituent. Among them, examples of particularly useful compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluenesulfonate and the like.

In the color developing solution to be used in the processing of the present invention, in addition to the above primary aromatic amine type color developing agent, it is also possible to incorporate an alkali agent such as sodium hydroxide, sodium carbonate, potassium carbonate and the like, an alkali metal sulfite, an alkali metal bisulfite, an alkali metal thiocyanate, an alkali metal halide, benzyl alcohol, a water softening agent and a thickening agent, etc., as desired. The pH value of the color developing solution is usually 7 or higher, most commonly about 10 to about 13.

In the present invention, after color developing processing, processing with a processing solution having fixing ability is performed. When the processing solution having said fixing ability is a fixing solution, bleaching processing is performed prior thereto. As the bleaching agent to be used in said bleaching step, a metal complex of an organic acid may be used, and said metal complex has the action of color forming the non-color formed portion of the color forming agent simultaneously with oxidizing the metal salt to return it to silver halide, its constitution comprising an organic acid such as aminopolycarboxylic acid or oxalic acid, citric acid, etc. coordinated with metal ions such as of iron, cobalt, copper, etc. The most preferred organic acid for formation of such a metal complex of an organic acid may include polycarboxylic acids or aminopolycarboxylic acids. These polycarboxylic acids, or aminopolycarboxylic acids may be alkali metal salts, ammonium salts or water-soluble amine salts.

Typical examples of these are enumerated below.

[1] Ethylenediaminetetraacetic acid
[2] Diethylenetriaminepentaacetic acid
[3] Ethylenediamine-N-(β-oxyethyl)-N,N',N'-triacetic acid
[4] Propylenediaminetetraacetic acid
[5] Nitrilotriacetic acid
[6] Cyclohexanediaminetetraacetic acid
[7] Iminodiacetic acid
[8] Dihydroxyethylglycinecitric acid (or tartaric acid)
[9] Ethyl ether diaminetetraacetic acid
[10] Glycol ether diaminetetraacetic acid
[11] Ethylenediaminetetrapropionic acid
[12] Phenylenediaminetetraacetic acid
[13] Disodium ethylenediaminetetraacetate
[14] Tetra(trimethylammonium)ethylenediaminetetraacetate
[15] Tetrasodium ethylenediaminetetraacetate
[16] Pentasodium diethylenetriaminetetraacetate
[17] Sodium ethylenediamine-N-(β-oxyethyl)-N,N',N'-triacetate
[18] Sodium propylenediaminetetraacetate
[19] Sodium nitrilotriacetate
[20] Sodium cyclohexanediaminetetraacetate The bleaching agent used may contain a metal complex of an organic acid as described above as the bleaching agent together with various additives. As such additives, it is particularly desirable to incorporate a rehalogenating agent such as an alkali halide or an ammonium halide, for example, potassium bromide, sodium bromide, sodium chloride, ammonium bromide, etc., a metal salt, a chelating agent. Also, those known to be added conventionally into the bleaching solution, including pH buffering agents such as borates, oxalates, acetates, carbonates, phosphates, etc., alkylamines, polyethyleneoxides, etc.

Further, the fixing solution and the bleach-fixing solution may also contain pH buffering agents comprising sulfites such as ammonium sulfite, potassium sulfite, ammonium bisulfite, potassium bisulfite, sodium bisulfite, ammonium metabisulfite, potassium metabisulfite, sodium metabisulfite, etc., or various salts such as boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc. either singly or as a combination of two or more compounds.

When the processing of the present invention is performed, while supplementing a bleach-fixing supplemental agent into the bleach-fixing solution (bath), said bleach-fixing solution (bath) may contain a thiosulfate, a thiocyanate or a sulfite, etc., or these salts may be contained in said bleach-fixing supplemental solution and supplemented to the processing bath.

In the present invention, for enhancing the activity of the bleach-fixing solution, blowing of air or oxygen may be effected if desired into the bleach-fixing bath and the storage tank for the bleach-fixing supplemental solution, or a suitable oxidizing agent such as hydrogen peroxide, a hydrobromic acid salt, a persulfate, etc. may adequately be added.

The present invention is described in more detail by referring to the following Examples, by which the embodiments of the present invention are not limited at all.

EXAMPLE 1

A solution of 40 g of the above exemplary magenta coupler (A-2) in a solvent mixture of 40 ml of dioctyl phthalate and 100 ml of ethyl acetate was added to 300 ml of a 5% aqueous gelatin solution containing sodium dodecylbenzenesulfonate, followed by dispersing by means of a homogenizer. The resultant dispersion was mixed with 500 g of a green-sensitive silver chlorobromide emulsion (containing 30 g of silver) and a coating aid was added thereto to prepare a coating solution. Subsequently, the coating solution was applied on a polyethylene-coated paper support, and further a coating solution containing 2-(2'-hydroxy-3',5'-di-t-amylbenzotriazole), gelatin, an extender and a film hardener was provided by coating to give a protective film.

During this operation, the amount of 2-(2'-hydroxy-3',5'-di-t-amyl-benzotriazole) was made 5 mg/dm$^2$ and that of gelatin 15 mg/dm$^2$ to prepare a light-sensitive silver halide photographic material, which is called Sample 1 (Control).

Next, Samples 2 to 7 were prepared in the same manner as preparation of Sample 1 except for adding metal complexes according to the present invention in combinations as indicated in Table 1 to the emulsion layer of Sample 1. These samples were subjected to optical wedge exposure by means of a sensitometer (Model KS-7, produced by Konishiroku Photo Industry K.K.), followed by the processing shown below.

Standard processing steps (processing temperature and processing time):

| | | |
|---|---|---|
| [1] Color developing | 38° C. | 3 min. 30 sec. |
| [2] Bleach-fixing | 33° C. | 1 min. 30 sec. |
| [3] Water washing | 25–30° C. | 3 min. |
| [4] Drying | 75–80° C. | ca. 2 min. |

Compositions of processing solutions:

| (Color developing solution) | |
|---|---|
| Benzyl alcohol | 15 ml |
| Ethylene glycol | 15 ml |
| Potassium sulfite | 2.0 g |
| Potassium bromide | 0.7 g |

-continued

| | |
|---|---|
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—(β-methanesulfonamidoethyl)-aniline sulfate | 5.5 g |
| Fluorescent whitening agent (4,4'-diaminostilbenesulfonic acid derivative) | 1.0 g |
| Potassium hydroxide | 2.0 g |

(made up to a total quantity of one liter with addition of water, and adjusted to pH 10.20).

| (Bleach-fixing tank solution) | |
|---|---|
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |

(adjusted to pH 7.1 with potassium carbonate or glacial acetic acid and made up to a total quantity of one liter with addition of water).

After processing, light-resistance of each sample obtained was measured in the following manner.

LIGHT-RESISTANCE TEST

The fading percentage $[(D_0-D)/D_0\times 100$; $D_0$: initial density (1.0), D: density after fading] was measured when the dye image formed on each sample was exposed to the sunlight by use of Underglass outdoor exposure stand for 400 hours.

These results are shown in Table 1.

TABLE 1

| Sample No. | Metal complex | Color fading (%) |
|---|---|---|
| 1 (Control) | — | 96 |
| 2 (Control) | Control antioxidant-1 (0.4) | 85 |
| 3 (This invention) | B-4 (0.4) | 43 |
| 4 (This invention) | B-9 (0.4) | 41 |
| 5 (This invention) | B-11 (0.4) | 40 |
| 6 (This invention) | B-13 (0.4) | 41 |
| 7 (Control) | Control metal complex-1 (0.4) | 80 |

The numerical values in the brackets indicate molar ratios relative to the coupler.

Control antioxidant-1

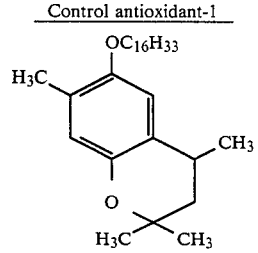

Control metal complex-1

-continued

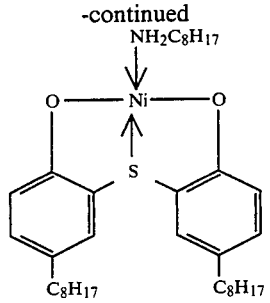

As apparently seen from Table 1, the metal complexes according to the present invention have greater effects for prevention against light fading for magneta coupler as compared with the antioxidants of the prior art.

This is an unexpected effect for prevention against light fading which cannot be obtained by the metal complex-1.

EXAMPLE 2

On a support consisting of a polyethylene-coated paper, the respective layers shown below were provided successively by coating to prepare a light-sensitive silver halide photographic material for multi-color.

First layer: blue-sensitive silver halide emulsion layer

A composition containing 8 mg/dm$^2$ of α-pivalyl-α-(1-benzyl-2,4-dioxo-imidazolidin-3-yl)-2-chloro-5-[γ-(2,4-di-t-amylphenoxy)butyramido]-acetanilide as the yellow coupler, 3 mg/dm$^2$ as calculated on silver of a blue-sensitive silver chlorobromide emulsion, 3 mg/dm$^2$ of 2,4-di-t-butylphenol-3',5'-di-t-amyl-4'-hydroxybenzoate, 3 mg/dm$^2$ of dioctyl phthalate and 16 mg/dm$^2$ of gelatin was provided by coating.

Second layer: intermediate layer

Gelatin was provided by coating to a coating amount of 4 mg/dm$^2$.

Third layer: green-sensitive silver chlorobromide emulsion layer

A composition containing 4 mg/dm$^2$ of the above exemplary magenta coupler (A-43), 2 mg/dm$^2$ as calculated on silver of green-sensitive chlorobromide emulsion, 4 mg/dm$^2$ of dioctyl phthalate and 16 mg/dm$^2$ of gelatin was provided by coating.

Fourth layer: intermediate layer

A composition containing 3 mg/dm$^2$ of 2-hydroxy-3',5'-di-t-amylphenol)-benzotriazole and 3 mg/dm$^2$ of 2-(2'-hydroxy-3',5'-di-t-butylphenol)-benzotriazole as UV-absorbers, 4 mg/dm$^2$ of dioctyl phthalate and 14 mg/dm$^2$ of gelatin was provided by coating.

Fifth layer: red-sensitive silver chlorobromide emulsion layer

A composition containing 1 mg/dm$^2$ of 2,4-dichloro-3-methyl-6-[α-(2,4-di-t-amylphenoxy)butyramido]-phenol, 3 mg/dm$^2$ of 2-(2,3,4,5,6-pentafluorophenyl-)acylamino-4-chloro-5-[α-(2,4-di-tert-amylphenoxy)-pentyramide] as cyan couplers, 2 mg/dm$^2$ of dioctyl phthalate, 3 mg/dm$^2$ as calculated on silver of a red-sensitive silver chlorobromide emulsion and 16 mg/dm$^2$ of gelatin was provided by coating.

Sixth layer: intermediate layer

A composition containing 2 mg/dm$^2$ of 2-(2'-hydroxy-3',5'-di-t-amylphenol)-benzotriazole, 2 mg/dm$^2$ of 2-(2'-hydroxy-3',5'-di-t-butylphenol)-benzotriazole as UV-absorbers, 2 mg/dm$^2$ of dioctyl phthalate and 6 mg/dm$^2$ of gelatin was provided by coating.

Seventh layer: protective layer

Gelatin was provided to a coating amount of 9 mg/dm$^2$.

The sample thus prepared is called Sample 8.

Next, Samples 9 through 23 were prepared in the same manner as preparation of Sample 8 except for changing the combination of the magenta coupler and the metal complex in the third layer of Sample 8 to those as indicated in Table 2.

For the samples thus prepared, the same exposure as in Example 1 was applied. However, optical wedge exposure was effected by use of green light in order to obtain a monochromatic sample of magenta. For each sample after exposure, light resistance of the magenta dye image was tested similarly as in Example 1.

Also for examination of the color purity of the magenta color formed sample, spectroscopic reflective density spectrum was measured in the following manner.

Measurement of spectroscopic reflective density spectrum of magenta color formed sample The spectroscopic reflection spectrum of the magenta color formed portion of each sample was measured by means of a color analyzer Model 607 (produced by Hitachi Seisakusho). In this measurement, the maximum density of the absorption spectrum at the visible region of each sample was normalized as 1.0.

The reflective density at 420 nm of each sample was defined as the side absorption density and used as a measure of color purity.

These results are shown in Table 2.

TABLE 2

| Sample No. | Magenta coupler | Metal complex | Color fading [%] | Side absorption density |
|---|---|---|---|---|
| 8 (Control) | A-43 | — | 93 | 0.20 |
| 9 (Control) | A-43 | Control anti-oxidant-1 | 84 | 0.20 |
| 10 (Control) | A-43 | Control metal complex-1 | 77 | 0.23 |
| 11 (This invention) | A-43 | B-2 | 10 | 0.20 |
| 12 (This invention) | A-43 | B-4 | 8 | 0.20 |
| 13 (This invention) | A-43 | B-11 | 7 | 0.21 |
| 14 (Control) | A-5 | — | 98 | 0.20 |
| 15 (This invention) | A-5 | B-4 | 35 | 0.20 |
| 16 (Control) | A-8 | — | 97 | 0.20 |
| 17 (This invention) | A-8 | B-4 | 34 | 0.20 |
| 18 (Control) | A-42 | — | 92 | 0.20 |
| 19 (This invention) | A-42 | B-4 | 10 | 0.20 |
| 20 (Control) | A-44 | — | 93 | 0.20 |
| 21 (This invention) | A-44 | B-4 | 15 | 0.20 |
| 22 (Control) | Control magenta coupler-1 | — | 60 | 0.37 |
| 23 (Control) | Control magenta coupler-2 | B-4 | 40 | 0.37 |

(note)
The amounts of metal complexes and antioxidants added are 0.4 in terms of molar ratio relative to the coupler, respectively.

Control magenta coupler-1

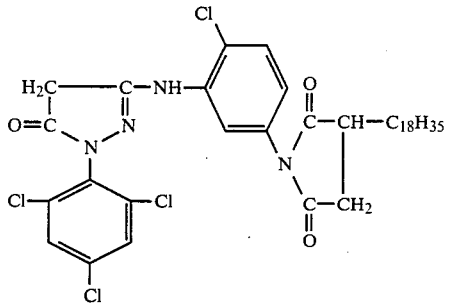

Control metal complex-1 and Control antioxidant-1 are the same as in Example 1.

It can be seen from Table 2 that the combinations of the metal complex according to the present invention and the magenta coupler according to the present invention are greater in the effect of improving light resistance as compared with the combination with the Control antioxidant-1 or the Control metal complex-1, or as compared with the combination of the metal complex according to the present invention with the Control magenta coupler. Particularly, it can be understood that this effect is marked when the group represented by R in the magenta coupler according to the present invention in the formula [I] is an alkyl group. These facts were entirely unexpected. Also, in the samples of the present invention, magenta images with good color purity and good light resistance could be obtained.

EXAMPLE 3

On a transparent support comprising a cellulose triacetate film subjected to subbing treatment having a halation preventive layer (containing 0.40 g of black colloid silver and 3.0 g of gelatin), the respective layers shown below were provided successively by coating to prepare Sample No. 24.

First layer: low sensitivity layer of red-sensitive silver halide emulsion layer A low sensitivity layer of a red-sensitive silver halide emulsion layer containing a dispersion of a solution of 1.8 g of a silver iodobromide emulsion (Emulsion I) color sensitized to red-sensitive, 0.8 g of 1-hydroxy-4-(β-methoxyethylaminocarbonylmethoxy)-N-[δ-(2,4-di-t-amylphenoxy)butyl]-2-naphthoamide (called C-1), 0.075 g of 1-hydroxy-4-[4-(1-hydroxy-8-acetamido-3,6-disulfo-2-naphthylazo)phenoxy]-N-[δ-(2,4-di-t-amylphenoxy)butyl]-2-naphthoamidodisodium (called CC-1), 0.015 g of 1-hydroxy-2-[δ-(2,4-di-t-amylphenoxy)-n-butyl]naphthoamide and 0.07 g of 4-octadecylsuccinimido-2-(1-phenyl-5-tetrazolylthio)-1-indanone (called D-1) dissolved in 0.65 g of tricresyl phosphate (called TCP) emulsified in an aqueous solution containing 1.85 g of gelatin.

Second layer: high sensitivity layer of red-sensitive silver halide emulsion layer A high sensitivity layer of a red-sensitive silver halide emulsion layer containing a dispersion of a solution of 1.2 g of a silver iodobromide emulsion (Emulsion II) color sensitized to red-sensitive, 0.21 g of the cyan coupler (C-1), 0.02 g of the colored cyan coupler (CC-1) dissolved in 0.23 g of TCP emulsified in an aqueous solution containing 1.2 g of gelatin.

Third layer: intermediate layer

An intermediate layer containing a solution of 0.8 g of gelatin and 0.07 g of 2,5-di-t-octylhydroquinone (called HQ-1) dissolved in 0.04 g of dibutylphthalate (called DBP).

Fourth layer: low sensitivity layer of green-sensitive silver halide emulsion layer A low sensitivity layer of a green-sensitive silver halide emulsion containing a dispersion of 0.80 g of the Emulsion I color sensitized to green-sensitive, 0.80 g of the exemplary compound (A-5) and 0.01 g of diethyllauric acid amide emulsified in an aqueous solution containing 2.2 g of gelatin.

Fifth layer: high sensitivity layer of green-sensitive silver halide emulsion layer A high sensitivity layer of a green-sensitive silver halide emulsion containing a dispersion of a solution of 1.8 g of the Emulsion II color sensitized to green-sensitive and 0.20 g of the exemplary compound (A-5) dissolved in 0.25 g of diethyllauric acid amide emulsified in an aqueous solution containing 1.9 g of gelatin.

Sixth layer: yellow filter

A yellow filter layer containing 0.15 g of yellow colloid silver, a solution of 0.2 g of the color staining preventive (HQ-1) dissolved in 0.11 g of DBP and 1.5 g of gelatin.

Seventh layer: low sensitivity layer of blue-sensitive silver halide emulsion layer A low sensitivity layer of a blue-sensitive silver halide emulsion layer containing a dispersion of a solution of 0.2 g of the Emulsion I color sensitized to blue-sensitive and 1.5 g of α-pivaloyl-α-(1-benzyl-2-phenyl-3,5-dioxyisoimidazolidin-4-yl)-2-chloro-5-[α-dodecyloxycarbonyl)ethoxycarbonyl]acetanilide (called Y-1) dissolved in 0.6 g of TCP emulsified in an aqueous solution containing 1.9 g of gelatin.

Eighth layer: high sensitivity layer of blue-sensitive silver halide emulsion layer A high sensitivity layer of a blue-sensitive silver halide emulsion layer containing a dispersion of a solution of 0.9 g of a silver iodobromide emulsion sensitized to blue-sensitive and 1.30 g of the yellow coupler (Y-1) dissolved in 0.65 g of TCP emulsified in an aqueous solution containing 1.5 g of gelatin.

Ninth layer: protective layer

A protective layer containing 0.23 g of gelatin.

In the same manner as in Sample No. 24 thus prepared, except for adding the metal complexes as indicated in Table 3 to the green-sensitive emulsion layer in an amount of 40 mole % based on the coupler, Samples No. 25 –29 were prepared.

Also, other samples were prepared by replacing the high boiling point organic solvent diethyllauric acid amide in the fourth and fifth layers in Sample 29 with trioctyl phosphate (Sample 30) and dioctyl phthalate (Sample 31).

Each of Samples No. 24–31 was subjected to wedge exposure by use of green light, followed by the developing processing shown below.

Developing processing steps:

| | | |
|---|---|---|
| Color developing solution | 38° C. | 3 min. 15 sec. |
| Bleaching solution | " | 4 min. 20 sec. |
| Water washing | " | 3 min. 15 sec. |
| Fixing solution | " | 4 min. 20 sec. |
| Water washing | " | 3 min. 15 sec. |
| Stabilizing solution | " | 1 min. 30 sec. |
| Drying | 47 ± 5° C. | 16 min. 30 sec. |

The color developing solution used had the following composition.

| | |
|---|---|
| Potassium carbonate | 30 g |
| Sodium hydrogen carbonate | 2.5 g |
| Potassium sulfite | 5 g |
| Sodium bromide | 1.3 g |
| Potassium iodide | 2 mg |
| Hydroxylamine sulfate | 2.5 g |
| Sodium chloride | 0.6 g |
| Sodium diethylenetriaminepentaacetate | 2.5 g |
| 4-Amino-3-methyl-N—ethyl-N—(β-hydroxyethyl)aniline sulfate | 4.8 g |
| Potassium hydroxide | 1.2 g |

(made up to one liter with addition of water, and adjusted to pH 10.06 by use of potassium hydroxide or 20% sulfuric acid).

The bleaching solution used had the following composition.

| | |
|---|---|
| Ammonium ethylenediaminetetraacetate | 100 g |
| Ethylenediaminetetraacetic acid | 10 g |
| Ammonium bromide | 150 g |
| Glacial acetic acid | 40 ml |
| Sodium hydrobromide | 10 g |

(made up to one liter with addition of water, and adjusted to pH 3.5 with aqueous ammonia or glacial acetic acid).

The fixing solution used had the following composition.

| | |
|---|---|
| Ammonium thiosulfate | 180 g |
| Anhydrous sodium sulfite | 12 g |
| Sodium metabisulfite | 2.5 g |
| Disodium ethylenediaminetetraacetate | 0.5 g |
| Sodium carbonate | 10 g |

(made up to one liter with addition of water).

The stabilizing solution used had the following composition.

| | |
|---|---|
| Formalin (37% aqueous solution) | 2 ml |
| Konidax (produced by Konishiroku Photo Industry K. K.) | 5 ml |

(made up to one liter with addition of water).

Light-resistance of the samples as prepared above was examined in the same manner as in Example 1.

The results are shown in Table 3.

TABLE 3

| Sample No. | Metal complex | Color fading (%) |
|---|---|---|
| 24 (Control) | — | 98 |
| 25 (Control) | Control antioxidant-1 | 89 |
| 26 (Control) | Control metal complex-1 | 83 |
| 27 (This invention) | B-2 | 45 |
| 28 (This invention) | B-4 | 48 |
| 29 (This invention) | B-11 | 47 |
| 30 (This invention) | B-11 | 32 |
| 31 (This invention) | B-11 | 31 |

Control metal complex-1 and Control antioxidant-1 are the same as those used in Example 1.

As can be clearly seen from Table 3, the metal complexes according to the present invention have greater effect of prevention against light color fading. Also, in samples of the present invention, clear color images could be obtained without any deleterious influence on the photographic image performances (sensitivity, gradation, fogging, etc.).

EXAMPLE 4

A solution of 40 g of the above magenta coupler (A-63) in a solvent mixture of 40 ml of dioctyl phthalate and 100 ml of ethyl acetate was added to 300 ml of an aqueous 5% gelatin solution containing sodium dodecylbenzenesulfonate, followed by dispersing by means of a homogenizer. The dispersion obtained was mixed with 500 g of a green-sensitive silver chlorobromide emulsion (containing 30 g of silver) and a coating aid was added thereto to prepare a coating solution. Subsequently, the coating solution was applied on a polyethylene-coated paper support, and further a coating solution containing 2-(2'-hydroxy-3,5'-di-t-amyl-benzotriazole), gelatin, an extender and a film hardener was provided by coating to give a protective film.

During this operation, the amount of 2-(2'-hydroxy-3',5'-di-t-amyl-benzotriazole) was made 5 mg/dm$^2$ and that of gelatin 15 mg/dm$^2$ to prepare a light-sensitive silver halide photographic material, which is called Sample 32 (Control).

Next, Sample 33 was prepared in the same manner as in Sample 32 except for adding, in molar ratio, 0.4 of the metal complex B-4 according to the present invention to the emulsion layer of Control sample 32. Further, Samples 34 through 38 were prepared in the same manner as in Sample 33 except for adding replacing the magenta coupler with the magenta couplers according to the present invention (A-71, A-92, A-59, A-52' and A-52").

A-52'

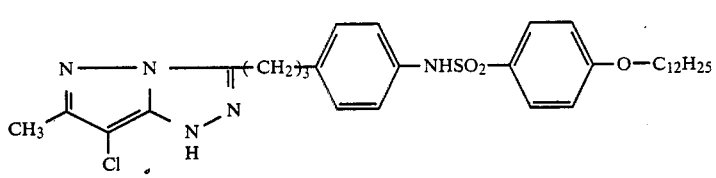

A-52"

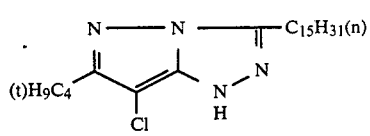

These samples were subjected to optical wedge exposure for sensitometry by means of a sensitometer (Model KS-7, produced by Konishiroku Photo Industry K.K.), followed by the processing shown below.

Standard processing steps (processing temperature and processing time):

| Processing steps | Processing temperature | Processing time |
|---|---|---|
| [1] Color developing | 32.8° C. | 3 min. 30 sec. |
| [2] Bleach-fixing | 32.8° C. | 1 min. 30 sec. |
| [3] Water washing | 32.8° C. | 3 min. 30 sec. |

The processing solutions used in the above processing steps had the following compositions.

| | |
|---|---|
| [Color developing solution] | |
| 4-Amino-3-methyl-N—ethyl-N—(β-methanesulfonamidoethyl)aniline sulfate | 5 g |
| Benzyl alcohol | 15 ml |
| Sodium hexametaphosphate | 2.5 g |
| Anhydrous sodium sulfite | 18.5 g |
| Sodium bromide | 0.7 g |
| Potassium bromide | 0.5 g |
| Borax | 39.1 g |
| (made up to one liter with addition of water, and adjusted to pH 10.3). | |
| [Bleach-fixing tank solution] | |
| Ferric ammonium ethylenediaminetetraacetate | 61.0 g |
| Diammonium ethylenediaminetetraacetate dihydrate | 5.0 g |
| Ammonium thiosulfate | 124.5 g |
| Sodium metabisulfite | 13.5 g |
| Anhydrous sodium sulfite | 2.7 g |
| (made up to one liter with addition of water). | |

After processing, light-resistance and the increased degree of colored staining (hereinafter called as yellow stain) due to perservation and gradation at leg portion were measured in the same manner as in Example 1.

These results are shown in Table 4.

TABLE 4

| Sample No. | Magenta coupler | Metal complex | Color fading [%] | Yellow stain | Gamma value |
|---|---|---|---|---|---|
| 32 (Control) | A-63 | none | 75 | 0.05 | 2.25 |
| 33 (This invention) | A-63 | B-4 | 11 | 0.05 | 2.31 |
| 34 (This invention) | A-71 | B-4 | 13 | 0.04 | 2.27 |
| 35 (This invention) | A-92 | B-4 | 12 | 0.05 | 2.28 |
| 36 (This invention) | A-59 | B-4 | 11 | 0.05 | 2.30 |
| 37 (This invention) | A-52′ | B-4 | 33 | 0.11 | 2.24 |
| 38 (This invention) | A-52″ | B-4 | 14 | 0.06 | 1.55 |

The numerical values of color fading % are better as they are smaller.

As apparently seen from Table 4, Samples Nos. 33 to 38 using the metal complexes according to the present invention have good light-resistance as compared with Sample No. 32 using no metal complex.

Further, Samples Nos. 33 to 36 using couplers where R in the formula (I) is a substituent of which the root atom directly bonded to the ring is a carbon atom having only one hydrogen atom (in the above cases, an iso-propyl group) are more preferred since they do neither cause any increment of yellow stain nor softening of the leg portion gradation, in addition to improvement in light-resistance.

EXAMPLE 5

On a support consisting of a polyethylene-coated paper, the respective layers shown below were provided successively by coating to prepare a light-sensitive silver halide photographic material for multi-color.

First layer: blue-sensitive silver halide emulsion layer

A composition containing 8 mg/dm$^2$ of α-pivalyl-α-(1-benzyl-2,4-dioxo-imidazolizin-3-yl)-2-chloro-5-[γ-(2,4-di-t-amylphenoxy)butyramido]-acetanilide as the yellow coupler, 3 mg/dm$^2$ as calculated on silver of a blue-sensitive silver halide emulsion, 3 mg/dm$^2$ of 2,4-di-t-butylphenol-3′,5′-di-t-amyl-4′-hydroxybenzoate, 3 mg/dm$^2$ of dioctyl phthalate and 16 mg/dm$^2$ of gelatin was provided by coating.

Second layer: intermediate layer

Gelatin was provided by coating to a coating amount of 4 mg/dm$^2$.

Third layer: green-sensitive silver halide emulsion layer

A composition containing 4 mg/dm$^2$ of the above exemplary magenta coupler (A-72), 2 mg/dm$^2$ as calculated on silver of green-sensitive chlorobromide emulsion, 4 mg/dm$^2$ of dioctyl phthalate and 16 mg/dm$^2$ of gelatin was provided by coating.

Fourth layer: intermediate layer

A composition containing 3 mg/dm$^2$ of 2-(2′-hydroxy-3′,5′-di-t-amylphenol)-benzotriazole and 3 mg/dm$^2$ of 2-(2′-hydroxy-3′,5′-di-t-butylphenol)-benzotriazole as UV-absorbers, 4 mg/dm$^2$ of dioctyl phthalate and 14 mg/dm$^2$ of gelatin was provided by coating.

Fifth layer: red-sensitive silver halide emulsion layer

A composition containing 1 mg/dm$^2$ of 2,4-dichloro-3-methyl-6-[α-(2,4-di-t-amylphenoxy)butyramido]-phenol and 3 mg/dm$^2$ of 2-(2,3,4,5,6-pentafluorophenyl-)acylamino-4-chloro-5-[α-(2,4-di-tert-amylphenoxy)-pentyramide] as cyan couplers, 2 mg/dm$^2$ of dioctyl phthalate, 3 mg/dm$^2$ as calculated on silver of a red-sensitive silver chlorobromide emulsion and 16 mg/dm$^2$ of gelatin was provided by coating.

Sixth layer: intermediate layer

A composition containing 2 mg/dm$^2$ of 2-(2′-hydroxy-3′,5′-di-t-amylphenol)-benzotriazole and 2 mg/dm$^2$ of 2-(2′-hydroxy-3′,5′-di-t-butylphenol)-benzotriazole as UV-absorbers, 2 mg/dm$^2$ of dioctyl phthalate and 6 mg/dm$^2$ of gelatin was provided by coating.

Seventh layer: protective layer

Gelatin was provided to a coating amount of 9 mg/dm$^2$.

The sample thus prepared is called Sample 39.

Next, Samples 40 through 56 were prepared in the same manner as in Sample 39 except for changing the combination of the magenta coupler and the metal complex in the third layer of Sample 39 to those as indicated in Table 5.

For the samples thus prepared, the same exposure as in Example 4 was applied. However, optical wedge exposure was effected by use of green light in order to obtain a monochromatic sample of magenta. For each sample after exposure, light resistance, yellow stain and leg portion gradation were measured similarly as in Example 4. The results are shown in Table 5.

TABLE 5

| Sample No | Magenta coupler | Metal complex | Color fading [%] | Yellow stain | Gamma value |
|---|---|---|---|---|---|
| 39 (Control) | A-72 | none | 73 | 0.05 | 2.23 |
| 40 (Control) | A-93 | none | 72 | 0.05 | 2.18 |
| 41 (This invention) | A-72 | B-3 | 11 | 0.05 | 2.24 |
| 42 (This invention) | A-93 | B-3 | 12 | 0.06 | 2.27 |
| 43 (This invention) | A-72 | B-4 | 11 | 0.04 | 2.25 |
| 44 (This invention) | A-93 | B-4 | 13 | 0.05 | 2.19 |
| 45 (This invention) | A-72 | B-11 | 13 | 0.05 | 2.31 |
| 46 (This invention) | A-93 | B-11 | 12 | 0.04 | 2.19 |
| 47 (Control) | A-72 | Control complex-2 | 65 | 0.08 | 0.97 |
| 48 (Control) | A-93 | Control complex-2 | 63 | 0.09 | 2.31 |
| 49 (Control) | A-52' | none | 95 | 0.05 | 2.15 |
| 50 (This invention) | A-52' | B-3 | 31 | 0.11 | 2.15 |
| 51 (This invention) | A-52' | B-4 | 30 | 0.11 | 2.24 |
| 52 (This invention) | A-52' | B-11 | 34 | 0.13 | 2.16 |
| 53 (Control) | A-52" | none | 85 | 0.04 | 2.01 |
| 54 (This invention) | A-52" | B-3 | 14 | 0.05 | 1.76 |
| 55 (This invention) | A-52" | B-4 | 16 | 0.05 | 1.55 |
| 56 (This invention) | A-52" | B-11 | 16 | 0.05 | 1.54 |

Control complex-2

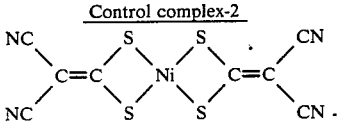

As is clear from Table 5, increase in color fading occurs in Samples Nos. 39, 40, 49 and 53 which employ no metal complex of the present invention.

In contrast, the samples of the present invention are free from increase in color fading. Further, when the magenta couplers having a substituent R of which the root atom directly bonded to the ring is a carbon atom having only one hydrogen atom (in the above cases, an iso-propyl group) are employed in combination of the metal complex according to the present invention, particularly preferred effects such as clear magenta images with good light-resistance and good color reproducibility can be obtained for the first time.

EXAMPLE 6

On a transparent support comprising a cellulose triacetate film subjected to subbing treatment having a halation preventive layer (containing 0.40 g of black colloid silver and 3.0 g of gelatn), the respective layers shown below were provided successively by coating to prepare Sample No. 57.

First layer: low sensitivity layer of red-sensitive silver halide emulsion layer A low sensitivity layer of a red-sensitive silver halide emulsion layer containing a dispersion of a solution of 1.8 g of an emulsion comprising AgBrI (Emulsion I) color sensitized to red-sensitive, 0.8 g of 1-hydroxy-4-(β-methoxyethylaminocarbonylmethoxy)-N-[δ-(2,4-di-t-amylphenoxy)butyl]-2-naphthoamide (called C-1), 0.075 g of 1-hydroxy-4-[4-(1-hydroxy-8-acetamido-3,6-disulfo-2-naphthylazo)phenoxy]-N-[δ-(2,4-di-t-amylphenoxy)butyl]-2-naphthoamidodisodium called CC-1), 0.015 g of 1-hydroxy-2-[δ-(2,4-di-t-amylphenoxy)-n-butyl]naphthoamide and 0.07 g of 4-octadecylsuccinimido-2-(1-phenyl-5-tetrazolylthio)-1-indanone (called D-1) dissolved in 0.65 g of tricresyl phosphate (called TCP) emulsified in an aqueous solution containing 1.85 g of gelatin.

Second layer: high sensitivity layer of red-sensitive silver halide emulsion layer A high sensitivity layer of a red-sensitive silver halide emulsion layer containing a dispersion of a solution of 1.2 g of an emulsion comprising AgBrI (Emulsion II) color sensitized to red-sensitive, 0.21 g of the cyan coupler (C-1), 0.02 g of the colored cyan coupler (CC-1) dissolved in 0.23 g of TCP emulsified in an aqueous solution containing 1.2 g of gelatin.

Third layer: intermediate layer

An intermediate layer containing a solution of 0.8 g of gelatin and 0.07 g of 2,5-di-t-octylhydroquinone (called HQ-1) dissolved in 0.04 g of dibutylphthalate (called DBP).

Fourth layer: low sensitivity layer of green-sensitive silver halide emulsion layer A low sensitivity layer of a green-sensitive silver halide emulsion containing a dispersion of 0.80 g of the Emulsion I color sensitized to green-sensitive, 0.80 g of the exemplary compound (A-72) and 0.01 g of diethyllauric acid amide dissolved 0.95 g of the compound (D-1) containing a DIR compound therein emulsified in an aqueous solution containing 2.2 g of gelatin.

Fifth layer: high sensitivity layer of green-sensitive silver halide emulsion layer A high sensitivity layer of a green-sensitive silver halide emulsion containing a dispersion of a solution of 1.8 g of the Emulsion II color sensitized to green-sensitive and 0.20 g of the exemplary compound (A-72) dissolved in 0.25 g of diethyllauric acid amide emulsified an an aqueous solution containing 1.9 g of gelatin.

Sixth layer: yellow filter

A yellow filter layer containing 0.15 g of yellow colloid silver, a solution of 0.2 g of the color staining preventive (HQ-1) dissolved in 0.11 g of DBP and 1.5 g of gelatin.

Seventh layer: low sensitivity layer of blue-sensitive silver halide emulsion layer A low sensitivity layer of a blue-sensitive silver halide emulsion layer containing a dispersion of a solution of 0.2 g of the Emulsion I color sensitized to blue-sensitive and 1.5 g of α-pivaloyl-α-(1-benzyl-5-phenyl-3,5-dioxyisoimidazolidin-3-yl)-2-chloro-5-[α-dodecyloxycarbonyl)ethoxycarbonyl]acetanilide (called Y-2) dissolved in 0.6 g of TCP emulsified in an aqueous solution containing 1.9 g of gelatin.

Eighth layer: high sensitivity layer of blue-sensitive silver halide emulsion layer A high sensitivity layer of a blue-sensitive silver halide emulsion layer containing a dispersion of a solution of 0.9 g of an emulsion comprising AgBrI containing 2 mole % of AgI sensitized to blue-sensitive and 1.30 g of the yellow coupler (Y-2) dissolved in 0.65 g of TCP emulsified in an aqueous solution containing 1.5 g of gelatin.

Ninth layer: protective layer

A protective layer containing 0.23 g of gelatin.

In the same manner as in Sample No. 57, except for adding the metal complexes as indicated in Table 6 to the green-sensitive emulsion layer in an amount of 40 mole % based on the coupler, Samples No. 58–62 were prepared.

Also, other samples were prepared by replacing the high boiling point organic solvent diethyllauric acid amide in the fourth and fifth layers in Sample 60 with trioctyl phosphate (Sample 63) and dioctyl phthalate (Sample 64).

Each of Samples No. 57–64 thus prepared was subjected to wedge exposure by use of green light, followed by the developing processing shown below.

Developing processing steps:

| | | |
|---|---|---|
| Color developing | 38° C. | 3 min. 15 sec. |
| Bleaching | " | 6 min. 30 sec. |
| Water washing | " | 3 min. 15 sec. |
| Stabilizing | " | 1 min. 30 sec. |
| Drying | | |

The processing solutions used in the respective processing steps had the following compositions.

| | |
|---|---|
| [Color developing solution] | |
| 4-Amino-3-methyl-N—ethyl-N—(β-hydroxyethyl)aniline sulfate | 4.75 g |
| Anhydrous sodium sulfite | 4.25 g |
| Hydroxylamine.½sulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| (made up to one liter with addition of water, and adjusted to pH 10.02). | |
| [Bleaching solution] | |
| Ferric ammonium ethylenediaminetetraacetate | 100 g |
| Diammonium ethylenediaminetetraacetate | 10.0 g |
| Ammonium bromide | 150.0 g |
| Glacial acetic acid | 10.0 ml |
| (made up to one liter with addition of water, and adjusted to pH 6.0 with ammonia water). | |
| [Fixing solution] | |
| Ammonium thiosulfate | 175.0 g |
| Anhydrous sodium sulfite | 8.5 g |
| Sodium metalbisulfite | 2.3 g |
| (made up to one liter with addition of water, and adjusted to pH 6.0 with acetic acid). | |
| [Stabilizing solution] | |
| Formalin (37% aqueous solution) | 1.5 ml |
| Konidax (produced by Konishiroku Photo Industry K.K.) | 7.5 ml |
| (made up to one liter with addition of water). | |

Light-resistance, yellow stain and gradation of the respective samples thus obtained were examined in the same manner as in Example 4.

The results are shown in Table 6.

TABLE 6

| Sample No. | Metal complex | Color fading [%] | Yellow stain | Gamma value |
|---|---|---|---|---|
| 58 (Control) | none | 98 | 0.05 | 0.62 |
| 59 (Control) | Control complex-1 | 86 | 0.12 | 0.32 |
| 60 (This invention) | B-2 | 45 | 0.05 | 0.64 |
| 61 (This invention) | B-4 | 43 | 0.04 | 0.63 |
| 62 (This invention) | B-11 | 42 | 0.06 | 0.65 |

TABLE 6-continued

| Sample No. | Metal complex | Color fading [%] | Yellow stain | Gamma value |
|---|---|---|---|---|
| 62 (This (invention) | B-4 | 23 | 0.06 | 0.62 |
| 63 (This invention) | B-4 | 21 | 0.05 | 0.63 |

As is apparent from Table 6, good magenta images with good light resistance and little increase in yellow stain or deterioration of gamma value can be obtained in the samples of the present invention. Also, clear images with good color reproducibility were obtained.

EXAMPLE 7

In the same manner as in Sample 33 in Example 4, except for changing the named magenta coupler (A-63) in Sample 33 in Example 4 to (A-99) and (A-104), Samples were prepared and subjected to exposure and processing, followed by measurements. As the result, the effect of the present invention was confirmed.

Light resistance of the magenta coupler according to the present invention, which is good in color purity and useful as the diequivalent coupler, could be improved to a great extent by combining it with the metal complex according to the present invention which can specifically react with said magenta coupler.

We claim:

1. A light-sensitive silver halide photographic material, which comprises at least one coupler represented by the formula (I) shown below and at least one of the compounds represented by the formulae (XI) and (XII) shown below:

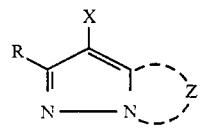

(I)

wherein Z represents a group of non-metallic atoms for forming a nitrogen-containing heterocyclic ring which may have a substituent; X represents a hydrogen atom or a substituent eliminatable through the reaction with the oxidized product of a color developing agent; and R represents a hydrogen atom or a substituent,

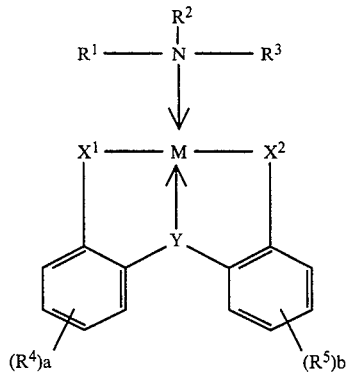

(XI)

-continued

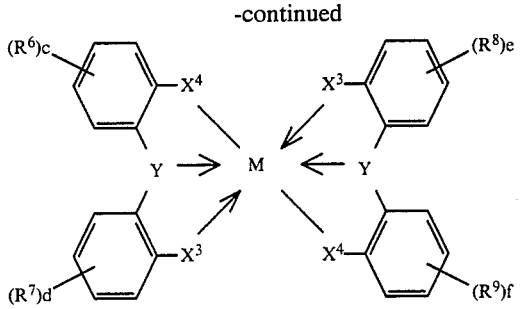

(XII)

wherein $X^1$, $X^2$ and $X^4$ each represents an oxygen atom, a sulfur atom or —$NR^{10}$— ($R^{10}$ represents a hydrogen atom, an alkyl group, an aryl group or a hydroxyl group); $X^3$ represents a hydroxyl group or a mercapto group; Y represents an oxygen atom or a sulfur atom; $R^1$, $R^2$ and $R^3$ each represents a hydrogen atom, an alkyl group or an aryl group, provided that at least two of $R^1$, $R^2$ and $R^3$ represent alkyl groups or aryl groups; $R^4$, $R^5$, $R^6$, $R^7$, $R^8$ and $R^9$ each represents an alkyl group, an aryl group, an alkoxy group, an aryloxy group, an alkoxycarbonyl group, an aryloxycarbonyl group, an acyl group, an acylamino group, an arylamino group, an alkylamino group, a carbamoyl group, a sulfamoyl group, a sulfonamide group, a sulfonyl group or a cycloalkyl group, or they can be linked to each other to form a 5- or 6-membered ring; M represents a metal atom; and a, b, c, d, e and f each represent an integer of 0 to 4.

2. A light-sensitive silver halide photographic material according to claim 1, wherein the coupler represented by the formula (I) is a coupler represented by the formulae (II) to (VII):

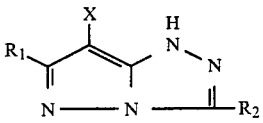

(II)

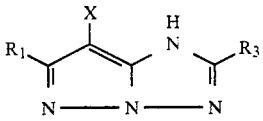

(III)

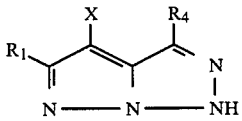

(IV)

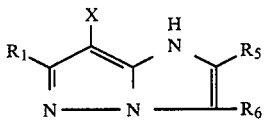

(V)

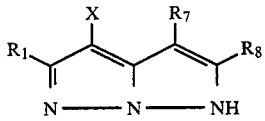

(VI)

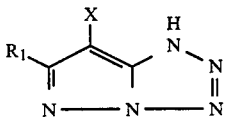

(VII)

wherein $R_1$ to $R_8$ and X each have the same meanings as the R and X in the formula (I).

3. A light-sensitive silver halide photographic material according to claim 1, wherein the coupler represented by the formula (I) is a coupler represented by the formula (VIII):

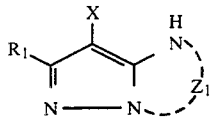

(VIII)

wherein $R_1$, X and $Z_1$ have the same meanings as R, X and Z in the formula (I).

4. A light-sensitive silver halide photographic material according to claim 1, wherein said substituent R has the formula (IX):

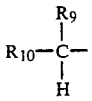

(IX)

wherein each of $R_9$ and $R_{10}$ represents a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

5. A light-sensitive silver halide photographic material according to claim 4, wherein both $R_9$ and $R_{10}$ are alkyl groups.

6. A light-sensitive silver halide photographic material according to claim 4, wherein said $R_9$ and $R_{10}$ are bonded together with the root carbon atom to form a cycloalkyl group.

7. A light-sensitive silver halide photographic material according to claim 1, wherein the amount of the coupler represented by the formula (I) is within the range of from $1\times10^{-3}$ mole to $5\times10^{-1}$ mole per mole of the silver halide.

8. A light-sensitive silver halide photographic material according to claim 1, wherein the amount of the compounds represented by the formula (XI) and (XII) is 5 to 100% by weight based on the coupler.

9. A light-sensitive silver halide photographic material according to claim 2, wherein the coupler represented by the formula (I) is a coupler represented by the formulae (II) or (III).

10. A light-sensitive silver halide photographic material according to claim 9, wherein the coupler represen6ted by the formula (I) is a coupler represented by the formula (II).

11. A light-sensitive silver halide photographic material according to claim 9, wherein the coupler represented by the formula (I) is a coupler represented by the formula (III).

12. A light-sensitive silver halide photographic material according to claim 1, wherein the $X^1$ and $X^2$ in the formulae (XI) and (XII) are each oxygen atoms.

13. A light-sensitive silver halide photographic material according to claim 1, wherein the Y in each of the formulae (XI) and (XII) is a sulfur atoms.

14. A light-sensitive silver halide photographic material according to claim 1, wherein the M in the formulae (XI) and (XII) is a transition metal.

15. A light-sensitive silver halide photographic material according to claim 1, wherein the M in the formulae (XI) and (XII) is nickel.

16. A light-sensitive silver halide photographic material according to claim 1, wherein R is a substituent of which the root atom directly bonded to the ring is a carbon atom having only one hydrogen atom bonded thereto.

17. A light-sensitive silver halide photographic material according to claim 1, wherein the substituent R is a halogen atom, an alkyl group, an alkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclicthio group; a cycloalkyl group, a cycloalkenyl group, a bridged hydrocarbon residual group, of which each root atom bonded directly to the ring is a carbon atom having only one hydrogen atom bonded thereto.

18. A light sensitive silver halide photographic material according to claim 1 wherein said coupler is present in an amount of from $1\times10^{-3}$ mole to $5\times10^{-1}$ mole per mole of silver halide and said compound having the formula (XI) or (XII) is present in an amount of 5 to 100% by weight based on the coupler.

19. A light sensitive silver halide photographic material according to claim 18 wherein said coupler is present in an amount of from $1\times10^{-2}$ mole to $5\times10^{-1}$ mole per mole of silver halide and said compound having the formula (XI) or (XII) is present in an amount of 10 to 50% by weight based on the coupler.

* * * * *